US005448978A

United States Patent [19]

Hasegawa et al.

[11] Patent Number: 5,448,978

[45] Date of Patent: Sep. 12, 1995

[54] FUEL METERING CONTROL SYSTEM AND CYLINDER AIR FLOW ESTIMATION METHOD IN INTERNAL COMBUSTION ENGINE

[75] Inventors: Yusuke Hasegawa; Hidetaka Maki; Shusuke Akazaki; Isao Komoriya; Toshiaki Hirota, all of Saitama, Japan

[73] Assignee: Honda Giken Kogyo Kabushiki Kaisha, Tokyo, Japan

[21] Appl. No.: 85,157

[22] Filed: Jul. 2, 1993

[30] Foreign Application Priority Data

| | | | |
|---|---|---|---|
| Jul. 3, 1992 | [JP] | Japan | 4-200329 |
| Jul. 3, 1992 | [JP] | Japan | 4-200330 |
| Jul. 3, 1992 | [JP] | Japan | 4-200331 |
| Jul. 21, 1992 | [JP] | Japan | 4-215665 |

[51] Int. Cl.[6] ..... F02M 51/00

[52] U.S. Cl. ..... 123/480; 123/478

[58] Field of Search ..... 123/478, 492, 361, 480; 364/431.06, 431.05

[56] References Cited

U.S. PATENT DOCUMENTS

| | | | |
|---|---|---|---|
| 4,357,923 | 11/1982 | Hideg | 123/492 |
| 4,359,993 | 11/1982 | Carlson | 123/492 |
| 4,446,523 | 5/1984 | Reinke . | |
| 4,667,640 | 5/1987 | Sekozawa et al. | 123/492 |
| 4,903,668 | 2/1990 | Ohta | 123/478 |
| 5,023,795 | 6/1991 | Matsumura et al. | 364/431.06 |
| 5,080,071 | 1/1992 | Minamitami et al. | 123/478 |
| 5,095,874 | 3/1992 | Schnaibel et al. | 123/361 |
| 5,263,455 | 11/1993 | Iwai et al. | 123/478 |

FOREIGN PATENT DOCUMENTS

| | | |
|---|---|---|
| 2-5745 | 1/1990 | Japan . |
| 2-173334 | 7/1990 | Japan . |
| 3-26839 | 2/1991 | Japan . |
| 4-369471 | 12/1992 | Japan . |
| 5-180044 | 7/1993 | Japan . |

*Primary Examiner*—Raymond A. Nelli

*Attorney, Agent, or Firm*—Nikaido, Marmelstein, Murray & Oram

[57] ABSTRACT

Fuel metering control system in an internal combustion engine utilizing adaptive control having an intake manifold wall's fuel adherence plant. In the system, an actual air/fuel ratio in the individual cylinders is accurately estimated using an exhaust manifold model with an observer. Also, an actual cylinder air flow is estimated using a fluid model. Based on them, a desired cylinder fuel flow is determined by dividing the actual cylinder air flow by a desired air/fuel ratio and an actual cylinder fuel flow is determined by dividing the actual cylinder air flow by the estimated actual air/fuel ratio. The adaptive controller operates such that the actual cylinder fuel flow constantly coincides with the desired cylinder fuel flow. In an embodiment, in order to respond the change in wall adherence parameters, a compensator is connected in series with the wall adherence plant, a virtual plant incorporating the compensator is postulated and when the transfer characteristics of the virtual plant is other than 1 or thereabout, the adaptive controller is operated to have a transfer characteristics inverse thereto. At the same time, a method for estimating cylinder air flow inducted in the engine using the aforesaid fluid model is explained.

45 Claims, 34 Drawing Sheets

FUEL FLOW
1.2
1
.8
.6
.4
.2
0
-.2
Desired cylinder fuel flow (solid curve) and plant output
= actual cylinder fuel flow (broken line curve)

A/F
17
16
15
14
A/F behavior
PARAMETER VALUES
2
1
0
-1
$b_0$
$r_0$
$S_0$
Converges to substantially constant value
0
40
80
120
160
200
240
280
320
360
400
Converges here
MRACS adaptive parameters
Cycle FUEL FLOW
1.2
.9
.6
.3
0
Desired cylinder fuel flow FUEL FLOW
1
.8
.6
.4
.2
Delay reduced
Response before implementing dead time
Actual cylinder fuel flow A/F
22
20
18
16
14
A/F before implementing dead time
Improved to near flat
0
4
8
12
16
20
24
28
32
36
A/F behavior
Cycle

CONSTANT GAIN METHOD $y_M(k)$ REFERENCE
$y(k)$ MRACS-PLANT
Y
2
1.5
1
.5
0
-.5
-1
-1.5
-2
$y_M(k)$ : Model reference output (output desired by y (k))
$y(k)$ : Plant output corrected by MRACS
CONSTANT GAIN METHOD $\hat{b}0(k)$
$\hat{r}2(k)$
$\hat{r}1(k)$
$\hat{s}1(k)$
$\hat{s}0(k)$ PARAMETER VALUES
.5
.4
.3
.2
.1
0
-.1
Varies following the plant variation
0
30
60
90
120
150
180
210
240
270
300
Cycle
$\hat{\theta}(k)$ : Convergence of control parameters

DECREASING GAIN METHOD

Y
2
1.5
1
.5
0
-.5
-1
-1.5
-2
$y_M(k)$ REFERENCE
$y(k)$ MRACS-PLANT
$y_M(k)$ : Model reference output (output desired by y (k))
$y(k)$ : Plant output corrected by MRACS
DECREASING GAIN METHOD PARAMETER VALUES
1.8
1.5
1.2
.9
.6
.3
0
-.3
-.6
-.9
$\hat{b}0(k)$
$\hat{r}2(k)$
$\hat{r}1(k)$
$\hat{s}1(k)$
$\hat{s}0(k)$
Varies following the plant variation
0
30
60
90
120
150
180
210
240
270
300
Cycle
$\hat{\theta}(k)$ : Convergence of control parameters

VARIABLE GAIN METHOD $y_M(k)$ REFERENCE
$y(k)$ MRACS-PLANT
Y
2
1.5
1
.5
0
-.5
-1
-1.5
-2
$y_M(k)$ : Model reference output (output desired by y (k))
y (k) : Plant output corrected by MRACS

VARIABLE GAIN METHOD $\hat{b}0(k)$
$\hat{r}2(k)$
$\hat{r}1(k)$
$\hat{s}1(k)$
$\hat{s}0(k)$
Varies following the plant variation
PARAMETER VALUES
2.5
2
1.5
1
.5
0
-.5
-1
-1.5
0
30
60
90
120
150
180
210
240
270
300
Cycle
$\hat{\theta}(k)$ : Convergence of control parameters

CONSTANT TRACE METHOD

Y
1.2
.9
.6
.3
0
-.3
-.6
-.9
-1.2
$y_M(k)$ REFERENCE
$y(k)$ MRACS-PLANT
$y_M(k)$ : Model reference output (output desired by y (k))
$y(k)$ : Plant output corrected by MRACS

CONSTANT TRACE METHOD

PARAMETER VALUES
.8
.6
.4
.2
0
-.2
-.4
-.6
0
30
60
90
120
150
180
210
240
270
300
Cycle
Varies following the plant variation
$\hat{b}0(k)$
$\hat{r}2(k)$
$\hat{r}1(k)$
$\hat{s}1(k)$
$\hat{s}0(k)$
$\hat{\theta}(k)$ : Convergence of control parameters h, i, j = 0, 1, 2, . . . . .

FUEL METERING CONTROL SYSTEM AND CYLINDER AIR FLOW ESTIMATION METHOD IN INTERNAL COMBUSTION ENGINE

BACKGROUND OF THE INVENTION

1. Field of the Invention

This invention relates to a system for controlling fuel metering in an internal combustion engine, more particularly to a system for controlling fuel metering in an internal combustion engine wherein the actual cylinder fuel flow is constantly maintained at a desired value by adaptively compensating for the fuel transport delay caused by adherence of the injected fuel to the wall of the intake manifold and the like. Also, this invention relates to a method for estimating cylinder air flow inducted in a cylinder of the engine.

2. Description of the Prior Art

During transient engine operation, a cylinder fuel flow is apt to be out of a desired value, and a lean or rich spike occurs in the air/fuel ratio. One cause for this is fuel transport delay caused by the adherence of fuel to the wall of the intake manifold etc. The behavior of the fuel transport delay changes depending on the operating states of the engine, initial manufacturing variance, and time-course changes of the intake manifold or the like owing to the adherence of deposits its wall. With a view to overcoming the problems caused by fuel transport delay, Japanese Laid-open Patent Publication Nos. 2(1990)-173,334 and 3(1991)-26,839 propose that fuel metering in an internal combustion engine be controlled by incorporating adaptive control in which a fuel adherence plant and a parameter adjuster are established such that the plant's output, i.e., an actual cylinder fuel flow coincides with a desired value even during transient operating state of the engine.

For adaptively compensating for fuel transport delay in a multicylinder internal combustion engine, however, it is indispensable to determine the air/fuel ratio at the individual cylinders with high precision so as to be able to estimate accurately the actual cylinder fuel flow inducted into the individual cylinders. Since the prior art controls proposed in the aforementioned references immediately use the air/fuel ratio measured at the exhaust gas confluence point for the whole cylinders, however, it is not able to estimate the actual cylinder fuel flow inducted into the individual cylinders with good accuracy.

SUMMARY OF THE INVENTION

An object of the invention is therefore to overcome the aforesaid drawbacks of the prior art by providing a system for controlling fuel metering in an internal combustion engine wherein the air/fuel ratio in each cylinder is accurately estimated, the actual cylinder fuel flow inducted into each cylinder is determined with high accuracy, and an fuel injection amount is adaptively controlled on the basis of the so determined actual cylinder fuel flow.

The operating states of the engine generating the fuel transport delay includes not only the states defined by engine coolant temperature, intake air temperature or the like that change relatively slow with respect to time, but also the state defined by manifold absolute pressure which varies rapidly. For example, when an accelerator pedal is depressed at a low engine speed, the manifold absolute pressure rises quickly, resulting in rapid change in the fuel adherence condition. Since, however, the prior art control observes only the engine's input-output response, it is not able to follow up such a rapid change in the engine operating state. In other words, the actual fuel behavior finishes its change before it appears as the change in the engine's output. The prior art control, nevertheless, estimates the adherence parameter only when the plant's output changes and hence, leaves much to be improved in control response.

Another object of the invention is therefore to overcome the aforesaid drawbacks of the prior art and to provide a system for controlling fuel metering in an internal combustion engine wherein the fuel behavior is observed at a real time such that the actual cylinder fuel flow follows a desired value with a better response according to the change in the fuel transport delay.

The fuel metering control is usually encountered with a time lag problem. More specifically, it is not possible to immediately detect the air/fuel ratio of a mixture supplied into an engine cylinder. It can only be detected after the mixture burns and resultant exhaust gas reaches an air/fuel ratio sensor provided at the exhaust gas passage and emerges as a chemical-electric output signal. In addition, the lag is enlarged by a time required for fuel metering calculation and other factors such as a timing lag in outputting the calculated value. Even when the fuel metering is conducted through an adaptive control, it is not free from the problem. Thus, without accurately adjusting a timing between the input and output in the control, it is impossible to carry out a correction for the fuel behavior so as to determine a proper manipulated variable (control input) particularly at transient operating state of the engine. In the prior art control, however, although the air/fuel sensor's detection lag is observed, no further attention is made for adjusting individual input and output timings in the adaptive controller.

Further object of the invention is therefore to overcome the aforesaid shortcoming of the prior art and to provide a system for controlling fuel metering in an internal combustion engine wherein no timing error occurs between a desired cylinder fuel flow and an output of a fuel adherence plant, i.e., an actual cylinder fuel flow so that an air/fuel ratio accurately converges on a desired value even at a transient operating condition of the engine.

Aside from the above, various methods have been proposed for measuring or estimating air flow drawn in an engine cylinder including the method for directly measuring the mass air flow or the so-called speed density method which estimates it through manifold absolute pressure. Both methods are, however, not free from the influence from engine transient operating condition, sensor's initial manufacturing variance or degradation in sensor's service life. In view of the above, there are proposed techniques to measure or estimate air flow by Japanese Laid-open Patent Publication No. 2(1990)-5745 and U.S. Pat. No. 4,446,523 utilizing a fluid dynamic model.

However, since the former technique proposed by the Japanese reference predicts pressure in the air intake passage and does not detect it directly, it was disadvantageous in accuracy. Further, since the former technique utilizes a recurrence formula, if the pressure be erroneously estimated, the error will then be accumulated and further enlarged. The latter technique proposed by the U.S. patent relates to a mass air flow meter for merely measuring the mass air flow rate passing through a throttle plate and is silent on estimating an actual cylinder air flow.

Still a further object of the invention is therefore to overcome the aforesaid drawbacks of the prior art and to provide a method for estimating cylinder air flow wherein estimation accuracy is enhanced by directly detecting the pressure in the air flow passage and even if an estimation occurs, the error will not influence the next estimation.

For realizing the objects, the present invention provides a system for controlling fuel metering in a multi-cylinder internal combustion engine, comprising first means for determining a desired cylinder fuel flow Ti(k-n) in response to operating states of the engine, second means for determining an actual cylinder air flow Gair(k-n) at a combustion cycle (k-n) at or earlier than the last, third means for dividing the value Gair(k-n) by an air/fuel ratio A/F (k-n) in the cylinder concerned at a combustion cycle at or earlier than the last combustion cycle to determine an actual cylinder fuel flow Gfuel (k-n) for individual cylinders, and fourth means for determining a fuel injection amount including a controller which simulates the behavior of fuel using fuel adhering to an air intake passage of the engine as a state variable, wherein said fourth means adaptively controlling the parameter such that the actual cylinder fuel flow Gfuel(k-n) constantly coincides with the desired cylinder fuel flow Ti(k-n) for the individual cylinders of the engine.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
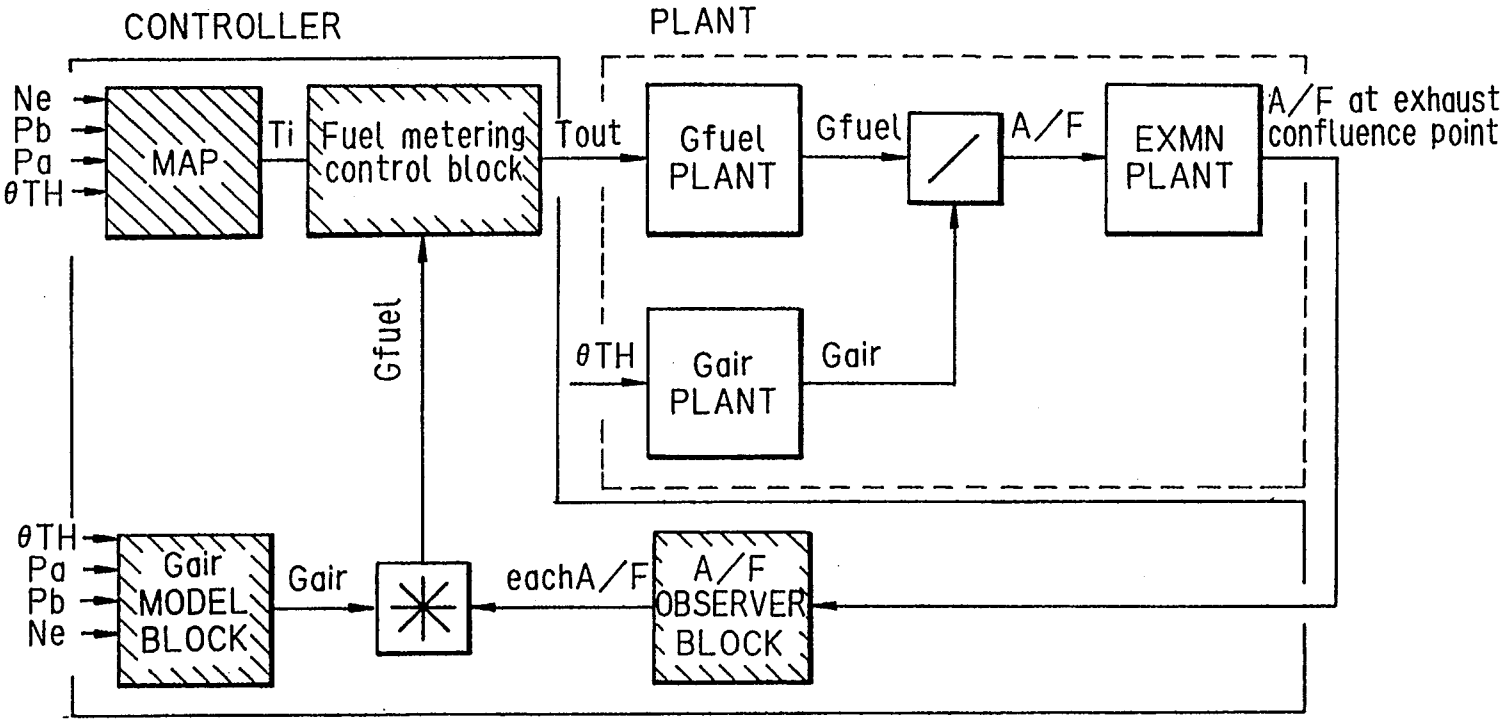
FIG. 1 is an overall block diagram showing a fuel metering control system according to the invention.

FIG. 1 is an overall block diagram of a fuel metering control system according to the present invention utilizing adaptive control. The control system includes a MAP block comprising predetermined characteristics prepared as a mapped data in a computer memory from which a desired cylinder fuel flow Ti is retrieved using engine speed Ne, manifold absolute pressure Pb and the like as address data, a Gair model block for estimating the dynamic behavior of an actual cylinder air flow Gair from throttle opening $\theta$TH, manifold absolute pressure Pb etc., and an A/F observer block for estimating an air/fuel ratio of the individual cylinders from the air/fuel ratio measured at the exhaust gas confluence point, and a fuel metering control block for determining an fuel injection amount Tout. In this configuration, the cylinder fuel flow Gfuel at each instant (combustion cycle) is estimated from the estimated (actual) cylinder air flow Gair and air/fuel ratio A/F, and the parameters of the fuel metering control block are adjusted to determine the fuel injection amount Tout such that the actual cylinder fuel flow Gfuel coincides with the desired cylinder fuel flow Ti. Here, the word "mapped" data means a data stored in a computer memory with respect to two parameters. similarly a word "table" means a look-up table stored in the memory with respect to a single parameter.

These will now be explained in detail.

The fuel metering control block will be explained first.

Figure 2:
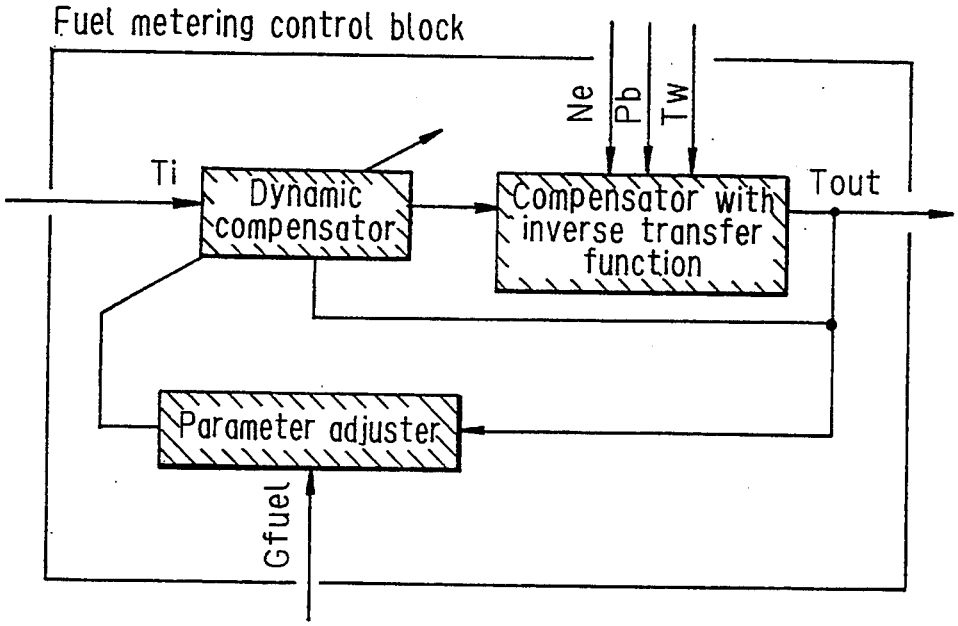
FIG. 2 is a block diagram focussing on a fuel metering control block redrawn from that illustrated in FIG. 1.

As regards fuel metering control, FIG. 1 can be redrawn as shown in FIG. 2. The input parameters are:

(1) Desired cylinder fuel flow Ti

Value obtained by dividing an actual cylinder air flow Gair estimated using the inputs from the sensors by a desired A/F ratio. (The calculation of the actual cylinder air flow Gair will be explained later.)

(2) Actual cylinder fuel flow Gfuel

Value obtained by dividing the actual cylinder air flow Gair by an actual air/fuel ratio at the same cylinder calculated from the value measured by an air/fuel ratio sensor. (The calculation of the actual air/fuel ratio at the individual cylinders will be explained later.)

(3) Others

Various measured and estimated values required by a wall adherence correction compensator (e.g., engine coolant temperature Tw, manifold absolute pressure Pb, engine speed Ne etc.)

Specifically, as is clear from the foregoing, the actual cylinder air flow Gair in a combustion cycle at a given time (k-n) is obtained and divided by the desired air/fuel ratio A/F (k-n) to determine the desired cylinder fuel flow Ti (k-n). In addition, the actual cylinder air flow Gair (k-n) in the same combustion cycle is divided by the measured and calculated air/fuel ratio A/F at the same cylinder to determine the actual cylinder fuel flow Gfuel (k-n). Then, a dynamic compensator in an adaptive controller is adjusted so that the actual cylinder fuel flow Gfuel (k-n) constantly coincides with the desired cylinder fuel flow Ti (k-n), whereby the manipulated variable (fuel injection amount) Tout is determined. In order to respond promptly to the aforesaid adherence parameters' change, the aforesaid wall adherence correction compensator is inserted ahead of a wall adherence plant. The transfer function of the wall adherence correction compensator is the inverse of that of the wall adherence plant. The adherence parameters of the wall adherence correction compensator are retrieved from a mapped data prepared beforehand on the basis of their correspondence with the engine operating states. If the adherence parameters of the wall adherence correction compensator are equal to adherence parameters of an actual engine, the transfer function of the two as seen from the outside is 1, namely the product of the transfer functions of the plant and the compensator is 1. Since this means that the actual cylinder fuel flow equals the desired cylinder fuel flow, perfect correction should be obtained. In fact, however, the adherence parameters generally vary complexly depending on the engine operating states, making it difficult to realize perfect coincidence. Moreover, the actual engine experiences initial manufacturing variance and time-course changes due to the adherence of deposits and the like. If these factors should cause the adherence parameters to vary between the compensator and the actual engine, the value of the transfer function will become something other than 1 or thereabout, i.e, 1.1, 1.2, 0.9, 0.8, . . . . Since time response therefore occurs, the desired cylinder fuel flow and the actual cylinder fuel flow will not be equal. In view of the above, therefore, a virtual plant incorporating the adherence correction compensator is postulated and when the transfer characteristic of the virtual plant is other than 1 or thereabout, the adaptive controller is operated to have a transfer characteristic inverse thereto. The desired cylinder fuel flow is input to the adaptive controller as a desired value and adaptive parameters are used which vary so that the actual cylinder fuel flow, namely the output of the virtual plant, coincides with the desired value. The parameters of the adaptive controller are calculated by an adaptive parameter adjuster (identifier). The adaptive parameter adjuster (identifier) uses input/output values including past values input to the virtual plant. The adaptive controller also functions to absorb errors in the estimated (actual) cylinder air flow. In other words, since in the end the adaptive parameters are adjusted so that coincidence is constantly maintained between the actual cylinder fuel flow obtained by dividing the cylinder air flow by the measured air/fuel ratio and the desired cylinder fuel flow obtained by dividing the cylinder air flow by the desired air/fuel ratio, any error in the estimated (actual) cylinder air flow can therefore be absorbed.

This will be explained in more detail.

As the wall adherence plant the first-order model such as expressed in Eq. 1 is used. Here, two parameters are used.

$$Qin(k)=A\cdot Qout(k)+B\cdot Qt(k-1)$$

$$Qt(k)=(1-B)\cdot Qt(k-1)+(1-A)\cdot Qout(k) \qquad \text{Eq. 1}$$

where

Qt (k): Wall adherence amount

A ($0 \leqq A \leqq 1$): Direct ratio (cylinder flow ratio)

B ($0 \leqq B \leqq 1$): Carry-off ratio (vaporization ratio)

Qin (k): Actual cylinder fuel flow

Figure 3:
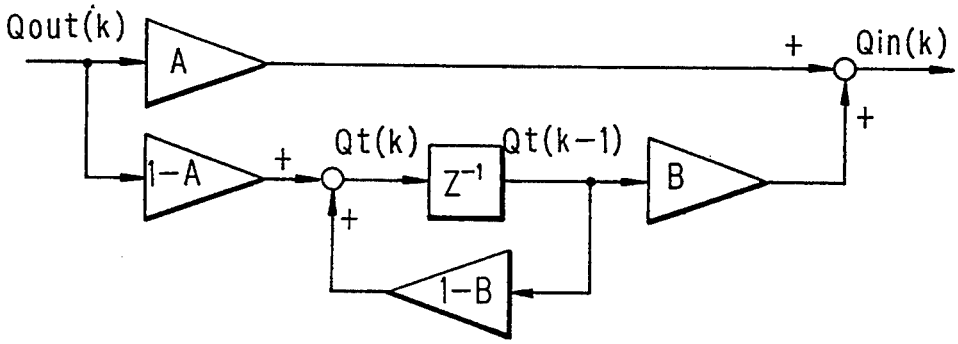
FIG. 3 is a block diagram showing a wall adherence plant referred to in FIG. 2.

Qout (k): Injector's injection amount;

Expressed as a discrete transfer function it becomes as shown in Eq. 2. Shown in block diagram it becomes as shown in FIG. 3.

$$\frac{Qin(z)}{Qout(z)} = \frac{Az-(A-B)}{Z-(1B)} \qquad \text{Eq. 2}$$

The transfer function of the wall adherence correction compensator is represented by Eq. 3. As mentioned earlier, it is the inverse of the transfer function of the wall adherence plant.

$$F(z) = \frac{z-(1-\hat{B})}{\hat{A}z-(\hat{A}-\hat{B})} \qquad \text{Eq. 3}$$

The characteristics of the aforesaid direct ratio A and the carry-off ratio B (here both expressed with a circumflex) of the wall adherence correction compensator are stored as the mapped data in advance as functions of the engine operating states, as earlier mentioned, such as engine coolant temperature Tw, manifold absolute pressure Pb, engine speed Ne and the like and are retrieved using the values of these. (In this specification, a value with the circumflex represents an estimated value.)

Figure 4:
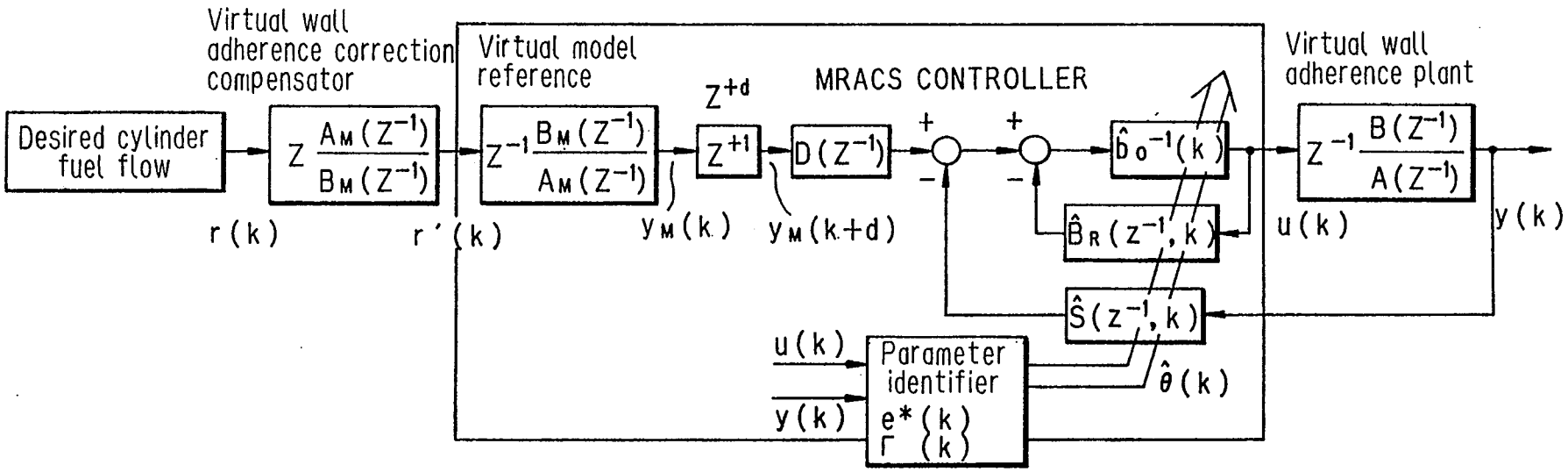
FIG. 4 is a block diagram showing that a Model Reference Adaptive Control System is applied for the wall adherence compensation illustrated in FIG. 2.

The adaptive controller will then be explained. Among the conditions required of the wall adherence correction are that it constantly work to reduce the transport delay and that it be able to follow variation in the A and B terms in the equations. A well-known system for achieving adaptive control that follows such a time-varying plant is MRACS (Model Reference Adaptive Control System). The configuration when MRACS is applied for wall adherence compensation is shown in FIG. 4. In this case, a priori model (model reference) can be taken near the center value of the time-varying plant or it can be taken so as to facilitate control of the wall adherence correction compensator. Since MRACS is effective only for a plant with dead time (delay time), dead time is apparently inserted by delaying input to the adherence plant by one cycle, thus constituting the virtual plant (the word "virtual" is appended to the inserted blocks).

Figure 5:
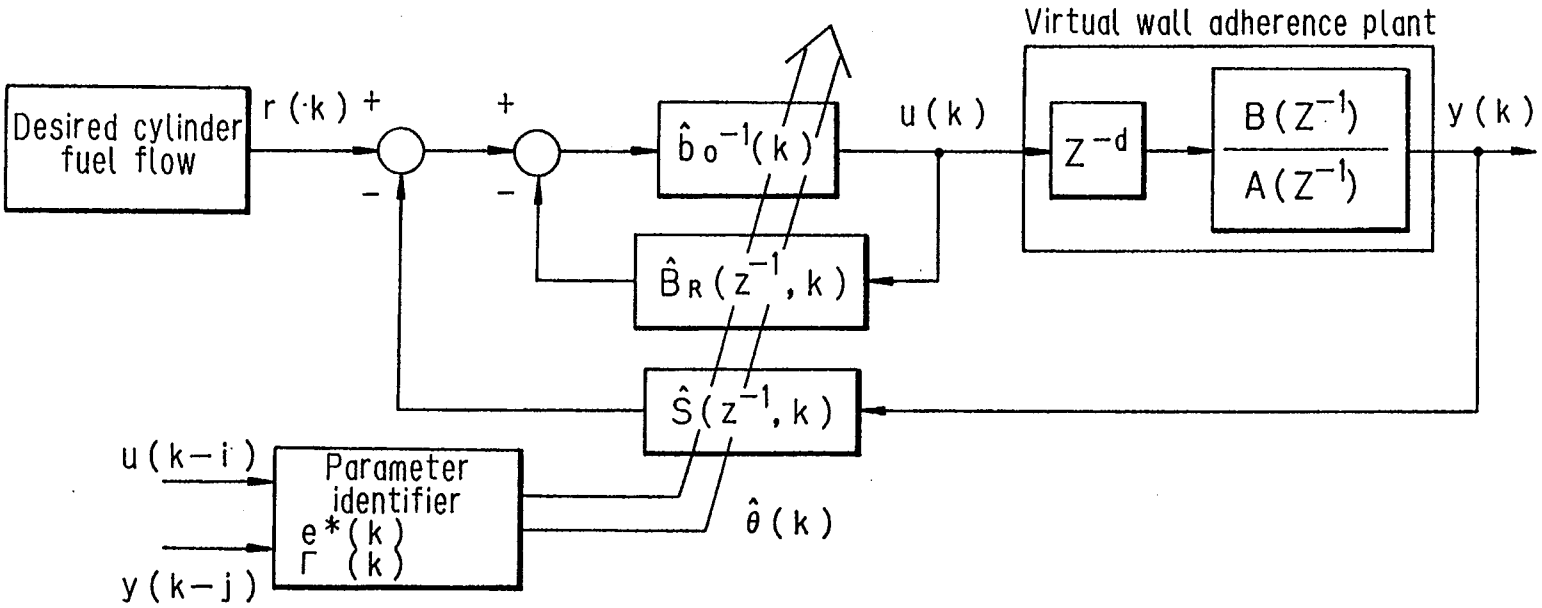
FIG. 5 is a block diagram showing rearranged configuration illustrated in FIG. 4.

It will be noted that the virtual adherence correction compensator and the virtual model reference are connected in series. Therefore, since their transfer functions are the inverse of each other, they can be canceled. This results in a $z^d=z$ (d=1) block and D ($z^{-1}$) remaining immediately after the virtual model reference. However, since z is a transfer function which outputs a future value, it cannot exist as it is. Therefore, by defining D ($z^{-1}$) as D ($z^{-1}$)=$z^{-1}$ the two can be canceled Although D ($z^{-1}$) is normally defined as D ($z^{-1}$)=$1+d_1 z^{-1}+\ldots+d_n z^{-n}$, defining it as D ($z^{-1}$)=$z^{-1}$ does not cause a problem regarding stability. Thus, rearranging FIG. 4 gives the configuration of FIG. 5. (As a result, the adaptive controller becomes a controller which handles a regulator problem and is modified to an STR (Self-Tuning Regulator). The adaptive controller receives the coefficient vectors identified by a parameter identifier, thus constituting a feedback compensator. However, since this operation is known (see, for example, the detailed explanation from page 28 to 41 in an article entitled "Digital Adaptive Control" in a magazine "Computrol" No. 27), it will not be explained further here.

Figures 6A, 6B, 6C:
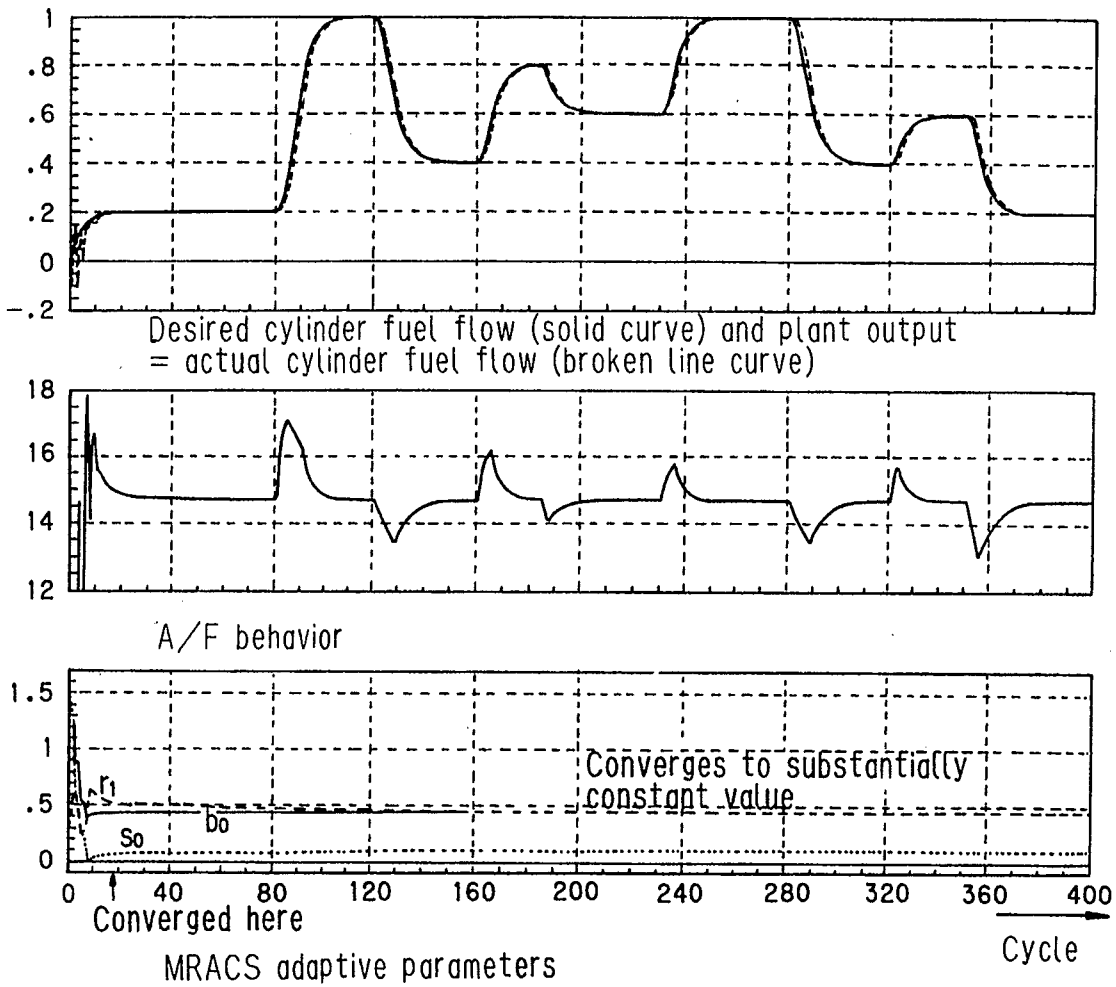
FIG. 6 is a view showing simulation results conducted on the configuration of FIG. 5.
Figures 7A, 7C:
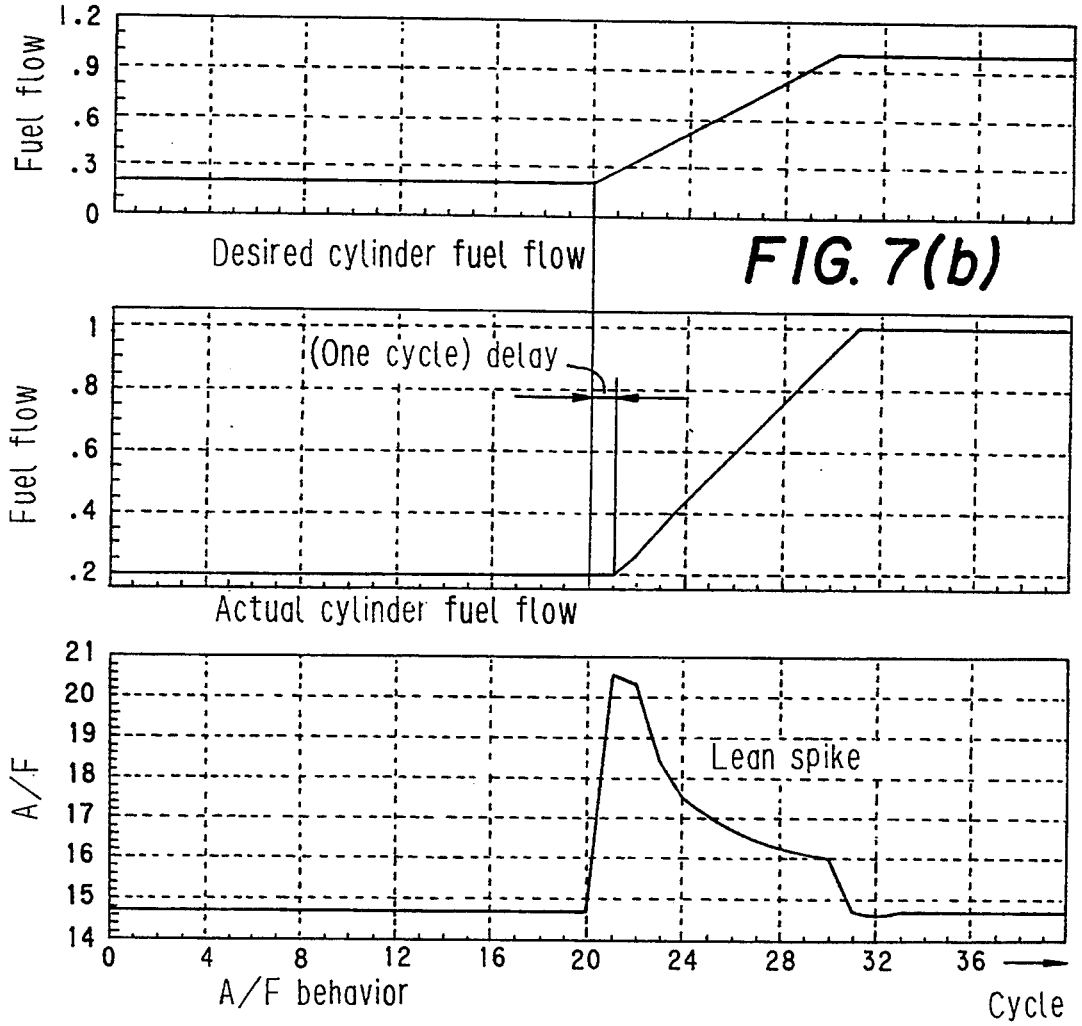
FIG. 7 is a view showing verification conducted on the data of FIG. 6.

FIG. 6 shows the responses obtained by simulation with the illustrated configuration. From this figure it can be seen that the MRACS parameter identifier operates normally in the aforesaid configuration, but that the behavior of the air/fuel ratio remains jagged. If, in order to verify this microscopically, a desired cylinder fuel flow such as shown in FIG. 7(*a*) is input, the plant output and the air/fuel ratio become as shown in FIGS. 7(*b*) and 7(*c*). It will be noted that the plant output is delayed by one cycle. This delay occurs because the virtual plant was constituted by insertion of dead time. It will also be noted that a lean spike occurs in the air/fuel ratio owing to the fact that during transient engine operation a one-cycle time difference arises between the desired cylinder fuel flow and the plant.

Figure 8:
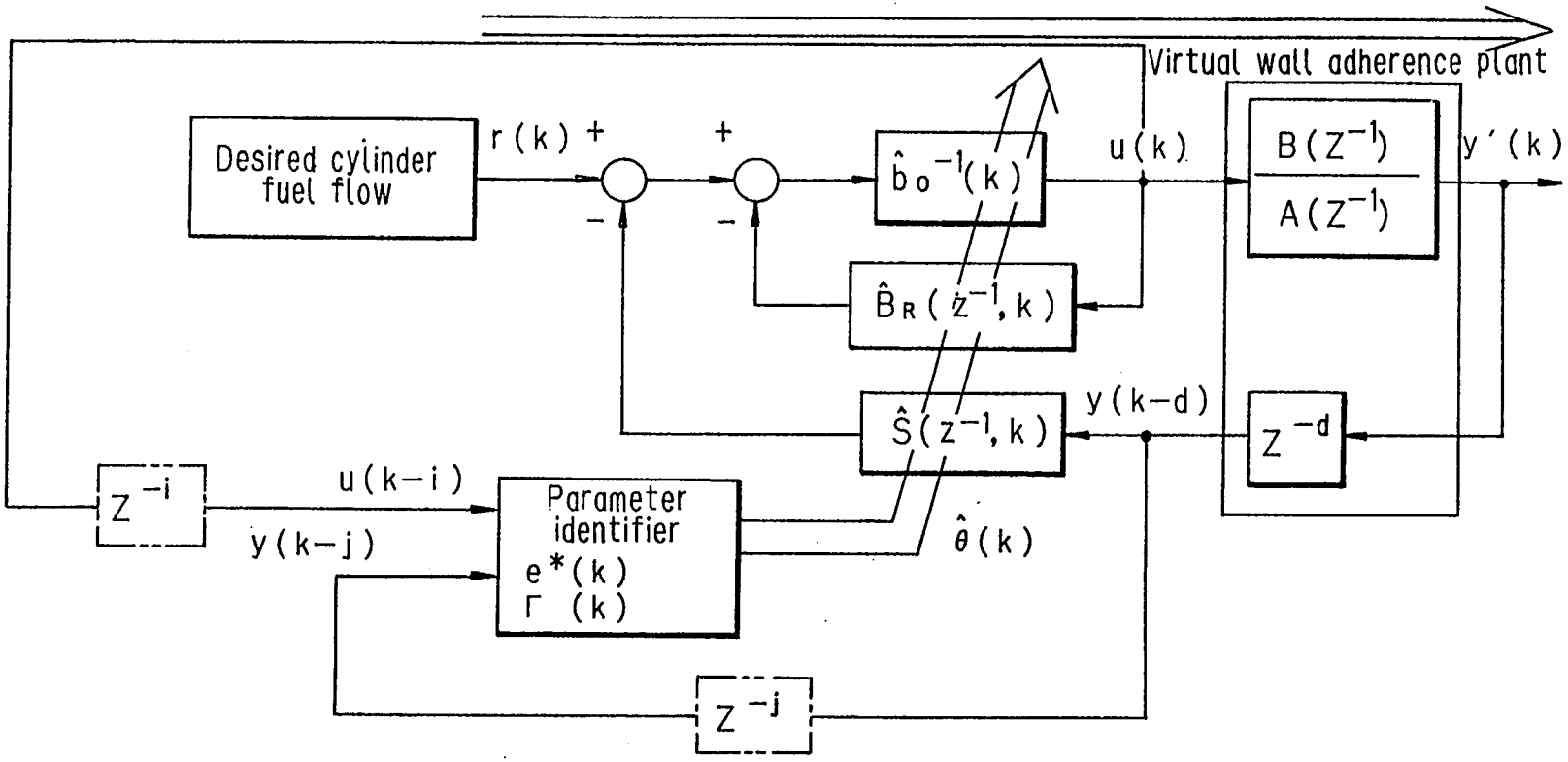
FIG. 8 is a block diagram illustrating a configuration provided with dead time in the configuration of FIG. 5.
Figures 9A, 9B, 9C:
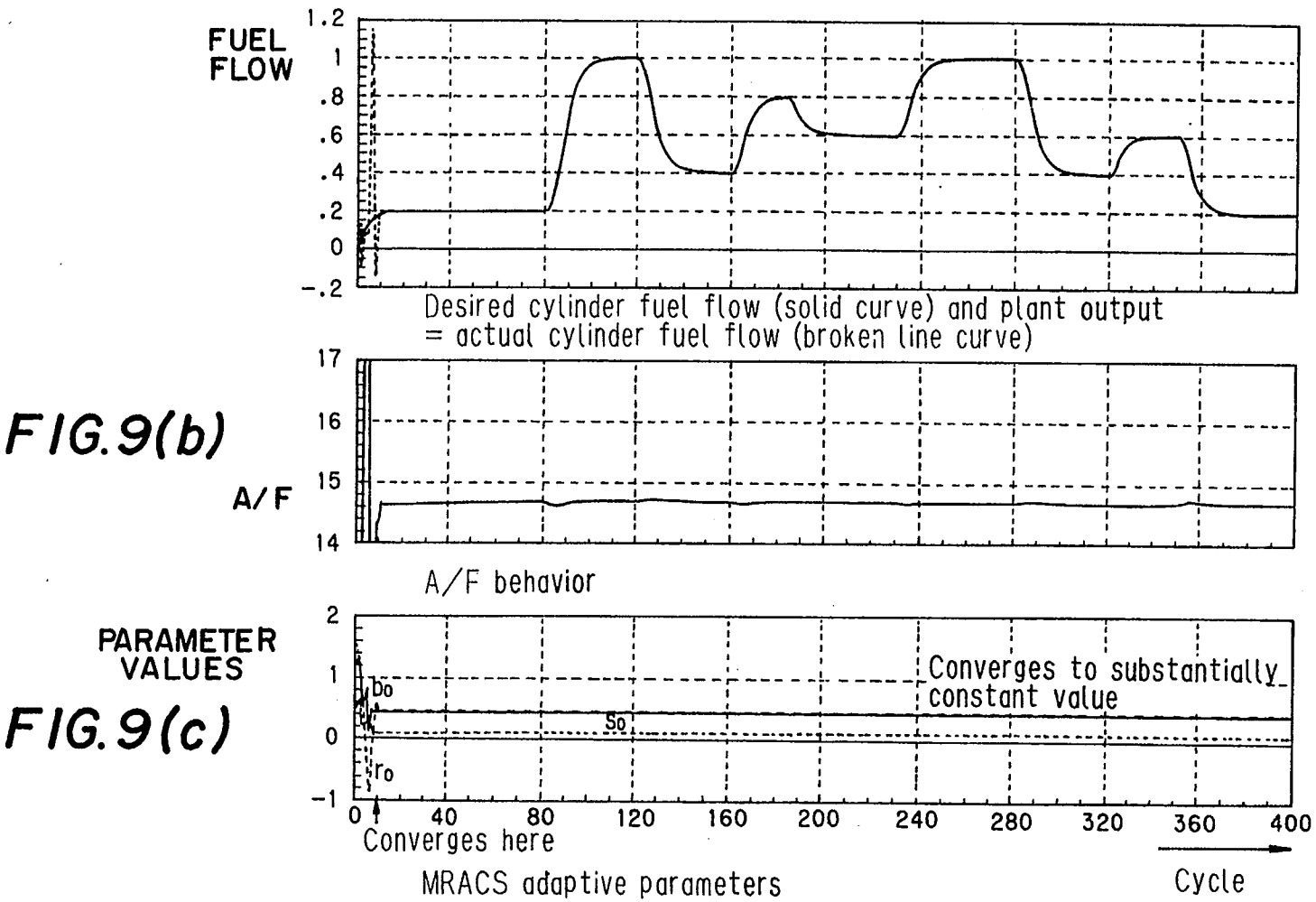
FIG. 9 is a view showing simulation results conducted on the configuration of FIG. 8.
Figures 10A, 10B, 10C:
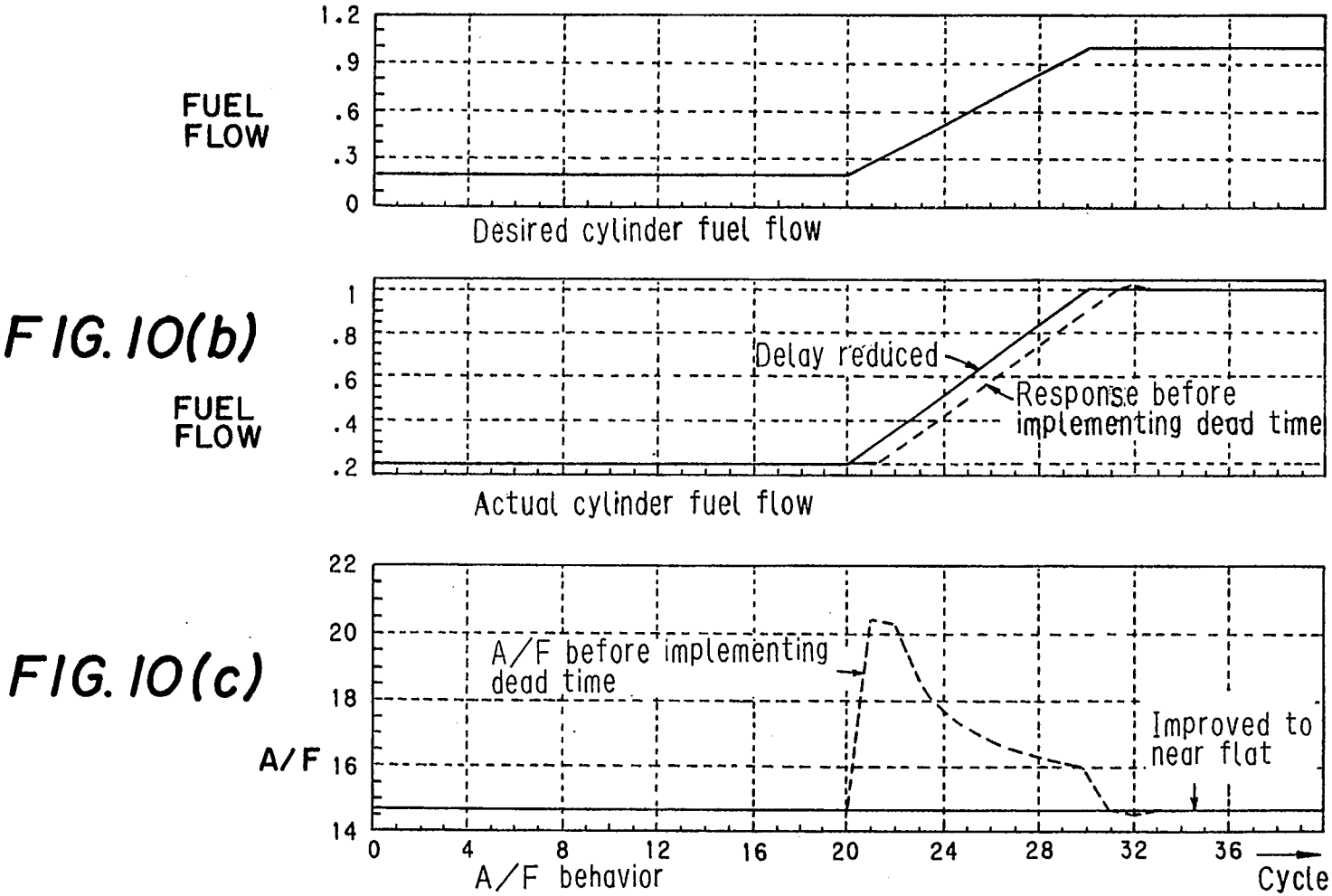
FIG. 10 is a view showing simulation results showing verification conducted on the data of FIG. 9.
Figure 11A:
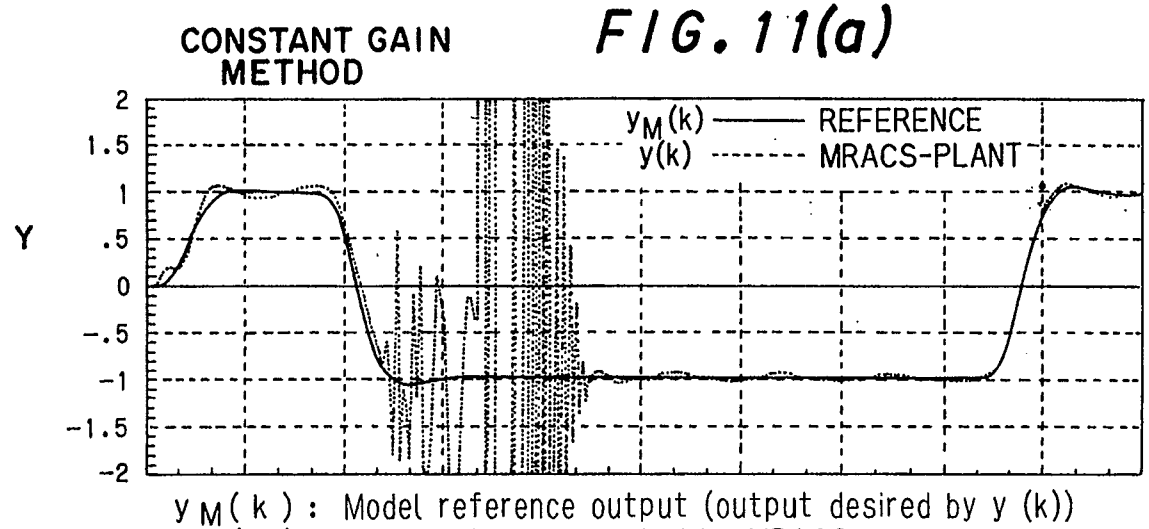
FIG. 11 is a view showing simulation results conducted on the configuration of FIG. 5 using a constant gain method.
Figure 11B:
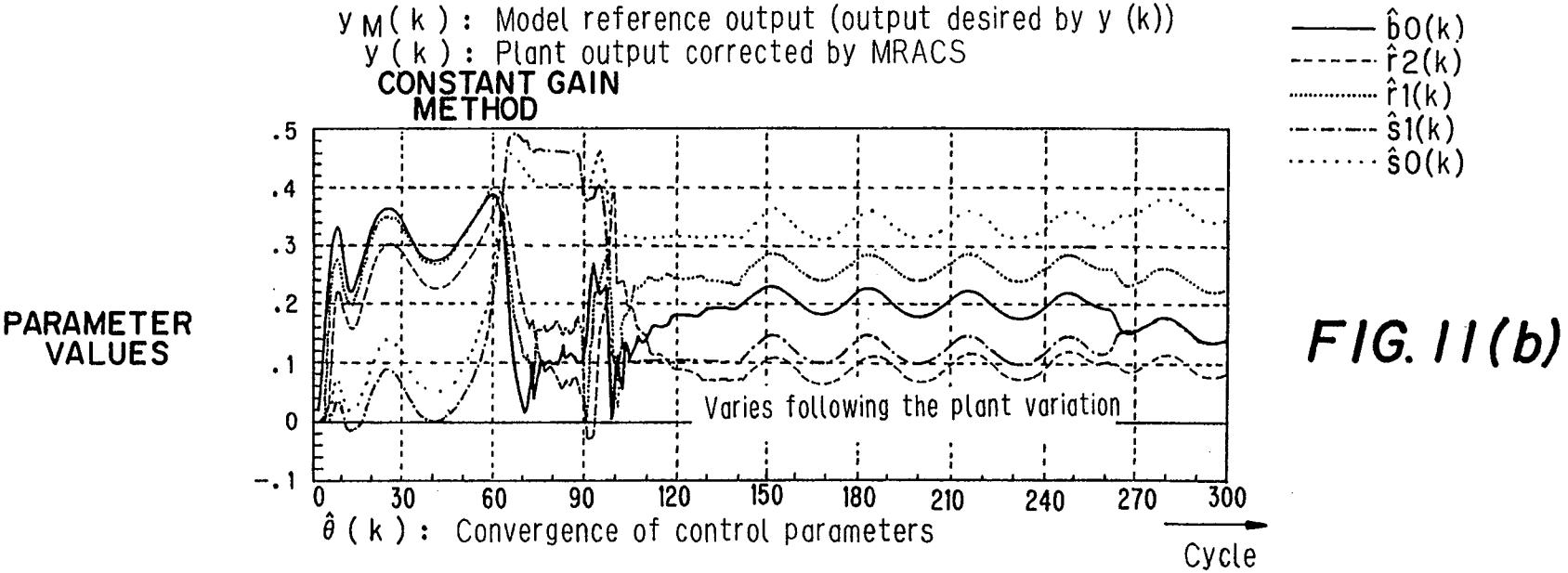
Figure 12A:
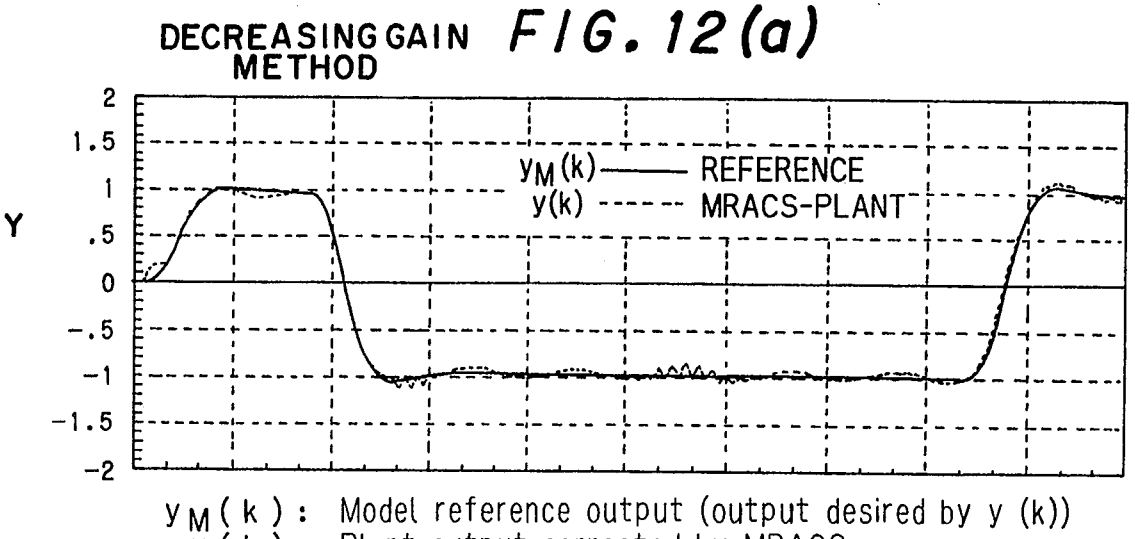
FIG. 12 is a view similar to FIG. 11, but using a decreasing gain method.
Figure 12B:
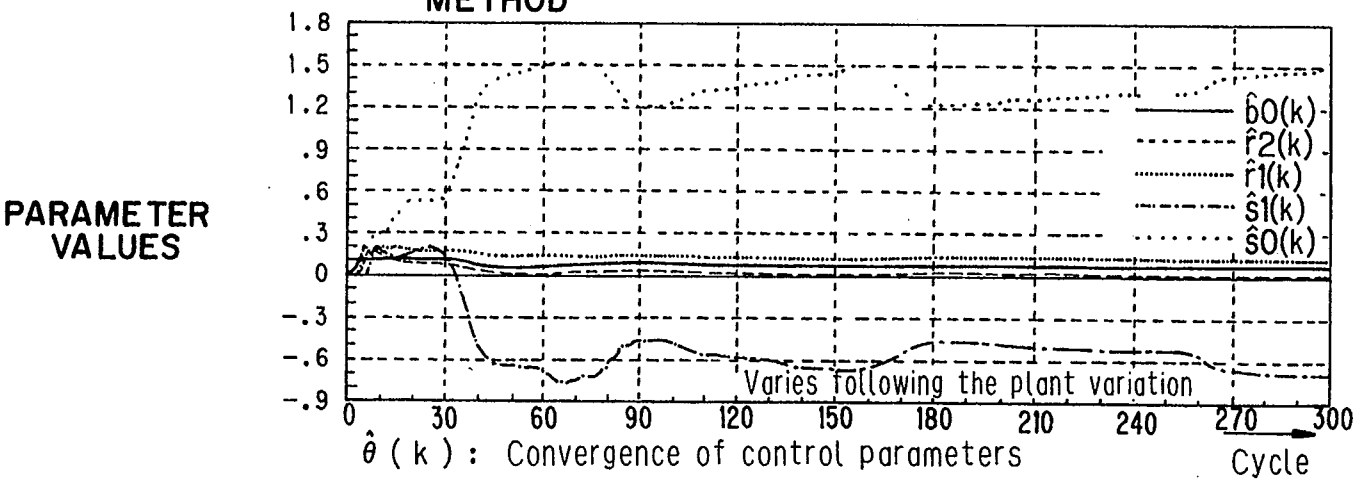
Figure 13A:
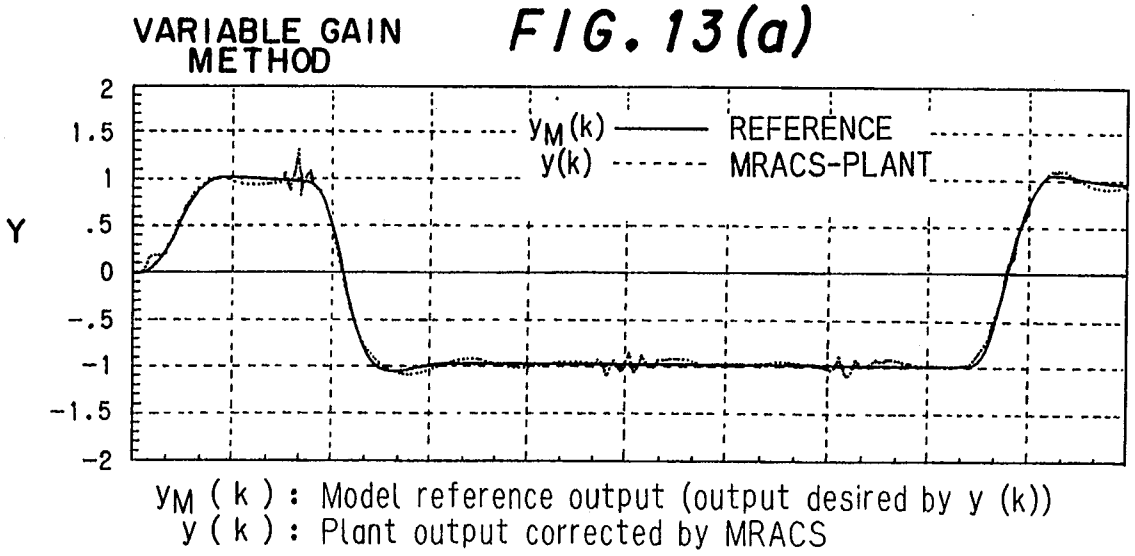
FIG. 13 is a view similar to FIG. 11, but using a variable gain method.
Figure 13B:
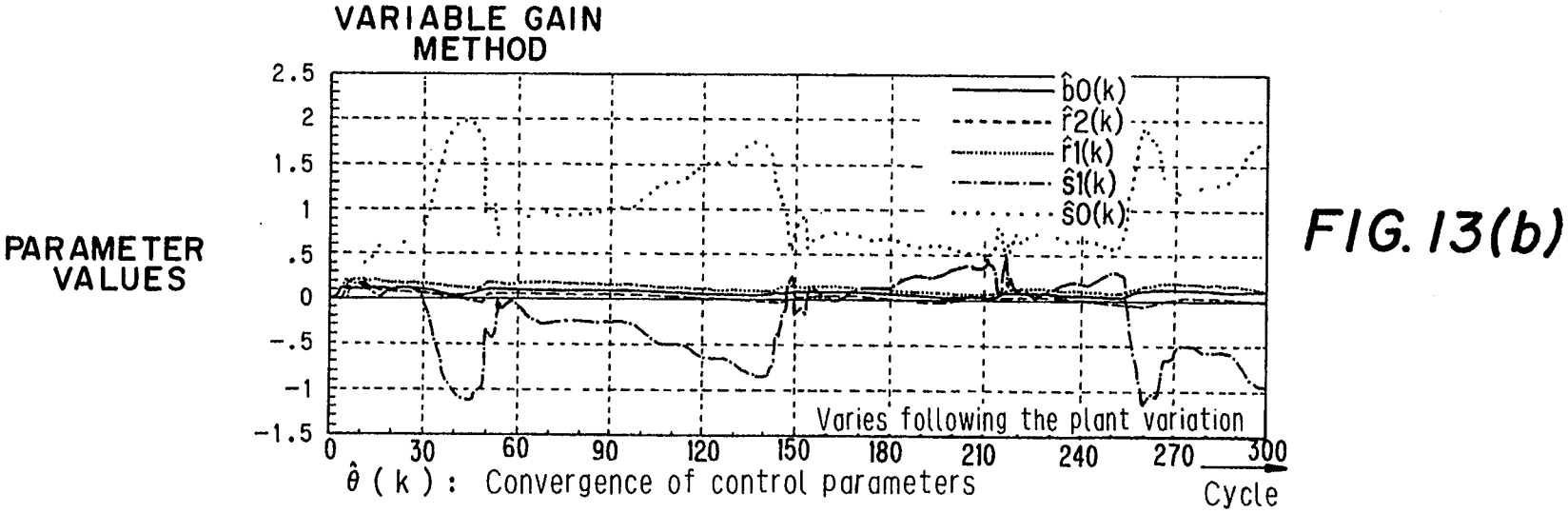
Figure 14A:
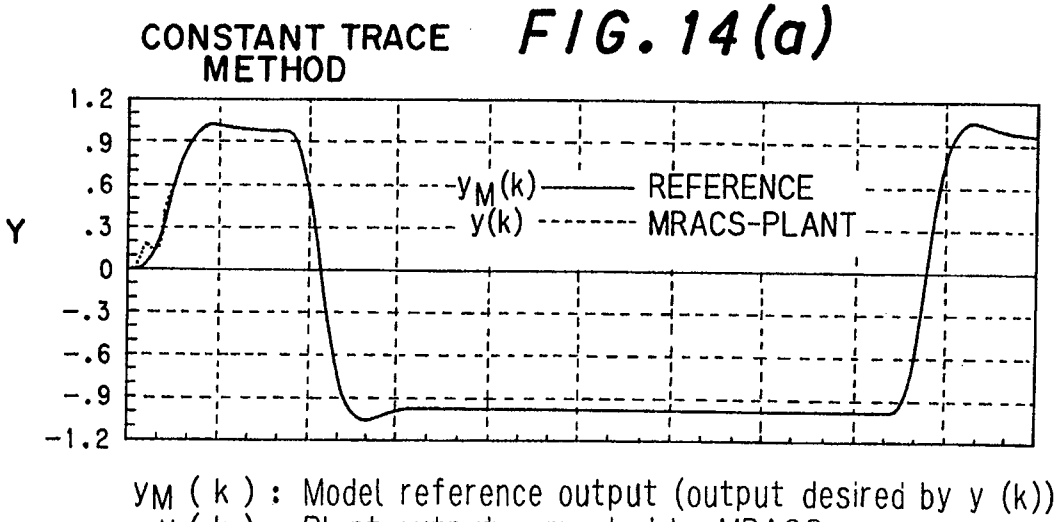
FIG. 14 is a view similar to FIG. 11, but using a constant trace method.
Figure 14B:
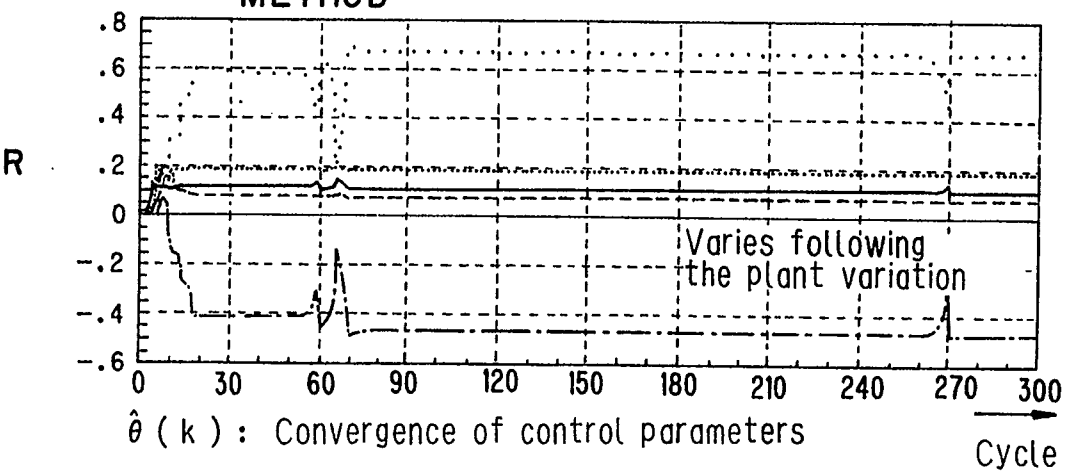

Since inserting the dead time $z^{-d}$ before the plant and inserting it after the plant are equivalent when the virtual plant is viewed from the outside, it is here inserted after. The plant output y' (k) is extracted immediately after the plant, i.e. between the plant and the dead time $z^{-d}$, and the virtual plant output y (k) required by the parameter identifier is extracted from after the dead time $z^{-d}$. This arrangement ensures that no dead time is present in the path from the input r (k) and the plant output y' (k) and enables the parameter identifier to use the virtual plant output y (k) including the dead time. The configuration is shown in FIG. 8. FIG. 9 shows the simulation results for the configuration of FIG. 8. As shown in FIG. 9(*c*), after convergence, the actual cylinder fuel flow becomes substantially equal to the desired cylinder fuel flow. The air/fuel ratio at this time stays flat in the vicinity of 14.7. Moreover, when the microscopic response after completion of identification is verified in the same scale, it becomes as shown in FIG. 10 (in which, for comparison, the response before implementing the dead time is shown by broken line curves). It will be noted that once the identification is completed the response after implementing the dead time is characterized by a very flat air/fuel ratio.

This insertion of dead time is not limited to that explained in the foregoing. As shown by the phantom blocks in FIG. 8, it can be appropriately inserted in the input and/or output in correspondence with the order of the plant output. This will later be referred in a fourth embodiment.

Turning next to the parameter identification laws, when the method proposed by I. D. Landau et al is used in the parameter identifier shown in FIG. 4, the gain matrix is represented by $$\Gamma(k)=\frac{1}{\lambda 1(k)}\left[\Gamma(k-1)-\frac{\lambda 2(k)\Gamma(k-1)\xi(k-d)\xi^T(k-d)\Gamma(rk-1)}{\lambda 1(k)+\lambda 2(k)\xi^T(k-d)\Gamma(k-1)\xi(k-d)}\right] \quad \text{Eq. 4}$$

Where: $0<\lambda 1(k)\leqq 1$, $0<\lambda 2(k)<2$, $\Gamma(0)>0$

The specific parameter identification laws are determined by how lambda 1(k) and lambda 2(k) are chosen. The typical MRACS identification laws fall in four categories: constant gain method, decreasing gain method (including the method of least squares), variable gain method (including the method of weighted least squares) and the constant trace method. Based on the configuration of FIG. 4, simulation was conducted with respect to each under the following conditions. Specifically, the time-varying plant was used since it is apt to be the one involved in application to the actual engine. FIGS. 11 to 14 show the results of the simulation. As will be understood from these simulation results, in the case of a time-varying plant, when the constant gain method is used (FIG. 11) the plant output value exhibits intense hunting centered on the desired value. The hunting is particularly pronounced when the desired value is changing (during transient engine operation). During transient engine operation the difference between the model reference and the plant output value, which is the desired value of the model reference output, becomes large and, therefore, the MRACS parameter identifier attempts to make a sudden great change in the parameter values. As a result, if, for example, the plant variation is too fast, overshooting occurs and causes hunting. In the case of the decreasing gain method (FIG. 12), the variable gain method (FIG. 13) and the constant trace method (FIG. 14), on the other hand, the plant output faithfully follows the model reference constituting the desired value. Although it oscillates in spots, it can be seen to converge on the desired value. Oscillation of this degree can be suppressed by adjusting the parameters, e.g. by varying the gain matrix values or D ($z^{-1}$), without sacrificing the convergence speed. Thus the last-mentioned three identification laws enable faster convergence speed than the constant gain method and can provide faithful following even if the plant is time variable.

The estimation of the actual cylinder air flow Gair will now be explained.

As was pointed out earlier, for accurately determining the actual cylinder fuel flow Gfuel it is necessary to determine the air mass flow rate with high precision. Conventional methods available for this include the method of measuring mass flow rate of air directly and the speed density method of indirect estimation from the manifold absolute pressure. However, since these known methods operate on the principle of retrieving the air flow rate from a mapped data prepared using parameters having a high degree of correlation with the cylinder air flow, they are powerless with respect to changes of the parameters not taken into account during preparing the mapped data and, therefore, lack toughness in respect of deterioration, variance and aging. Moreover, since preparing the mapped data can intrinsically be conducted only with respect to steady-state engine operating conditions, it cannot express transient engine operating states. This means that for transient engine operation there is no choice other than to have set the cylinder air flow in advance by an engineer's volition. In this invention, therefore, there is applied a fluid dynamic model capable of reflecting variation in the air flow under various air intake system conditions. Notwithstanding that the measurement is more indirect than in the conventional methods, its accuracy is higher owing to the fact that preparation of the mapped data or setting the data by an engineer's volition is eliminated. More specifically, the throttle is viewed as an orifice, the mass of air passing through the throttle is estimated using a fluid dynamic model of the vicinity of the throttle, and the actual air mass flow rate past the throttle is dynamically estimated with consideration to the chamber charging delay. This will now be explained.

Figure 15:
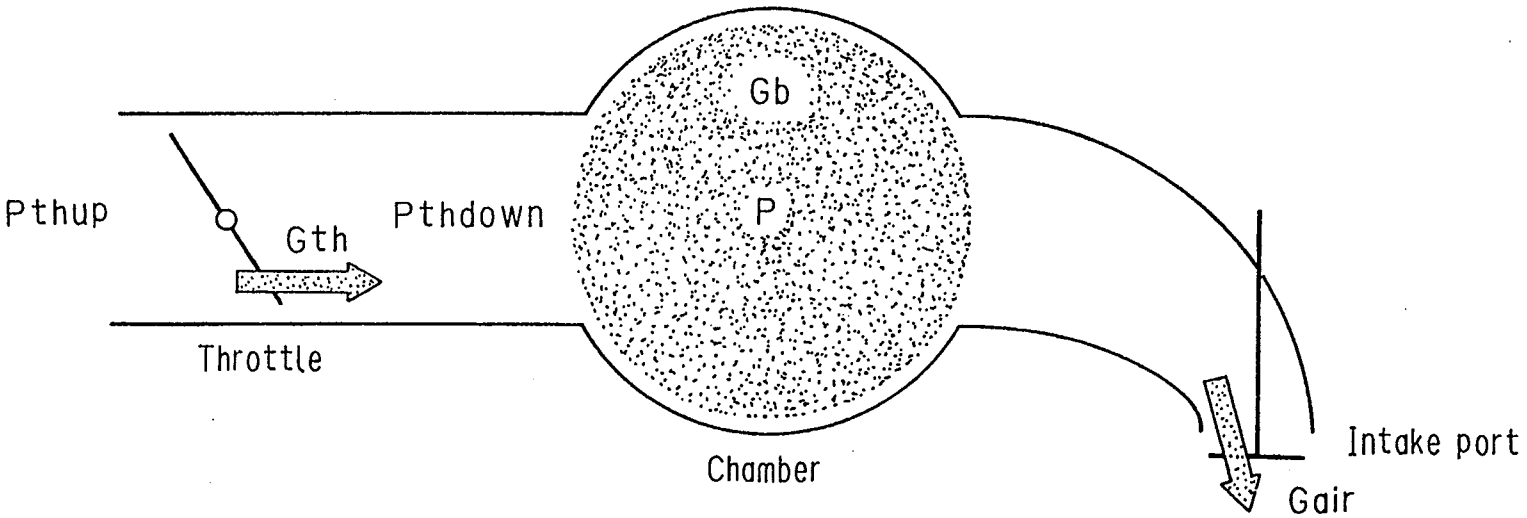
FIG. 15 is a view showing an air intake system model for estimating cylinder air flow to be used in the fuel metering control illustrated in FIG. 1.

If the throttle is viewed as an orifice as shown in an air intake system model of FIG. 15, it is possible from Eq. 5 (Bernoulli's equation), Eq. 6 (equation of continuity) and Eq. 7 (relational equation of adiabatic process) to derive Eq. 8, which is a standard orifice equation for compressible fluid flow. It is thus possible to determine the air mass flow rate Gth through the throttle valve per unit time.

$$\frac{v_1^2}{2} + \frac{\kappa}{\kappa - 1} \cdot \frac{P_1}{\rho_1} = \frac{v_2^2}{2} + \frac{\kappa}{\kappa - 1} \cdot \frac{P_2}{\rho_1} \qquad \text{Eq. 5}$$

where the flow is assumed to be the adiabatic process, and $P_1$: Absolute pressure on upstream side
$P_2$: Absolute pressure on downstream side
$\rho_1$: Air density on upstream side
$\rho_2$: Air density on downstream side
$v_1$: Flow velocity on upstream side
$v_2$: Flow velocity on downstream side
$\kappa$: Ratio of specific heats $$\rho_1 \cdot v_1 \cdot A_{up} = \rho_2 \cdot v_2 \cdot S \qquad \text{Eq. 6}$$

where:
$A_{up}$: Flow passage area on upstream side
S: Throttle projection area [=f($\theta$TH)]

$$\frac{P_1}{\rho_1^{\kappa}} = \frac{P_2}{\rho_2^{\kappa}} \qquad \text{Eq. 7}$$

$$Gth = \epsilon \cdot \rho_1 \cdot \alpha \cdot S \cdot \sqrt{\frac{2g \cdot (P_1 - P_2)}{\gamma_1}} \qquad \text{Eq. 8}$$

where:
g: Gravitational acceleration
$\gamma_1$: Air specific weight on upstream side ($=\rho_1 \cdot g$)
$\alpha$: Flow rate coefficient (coefficient of discharge)

$$\left( = \frac{C_v \cdot C_c}{\sqrt{1 - C_c^2 (d/D)^4}} \right)$$

where:
$C_v$: Velocity coefficient
$C_c$: Contraction coefficient [$= f(S/A_{up})$]
$D$: Bore diameter on upstream side
$d$: Throttle aperture diameter $\epsilon$: Correction coefficient (expansion factor of gas)

$$\left( = \frac{\left(\frac{\kappa}{\kappa - 1}\right)\left(\left(\frac{P_2}{P_1}\right)^{(2/\kappa)} - \left(\frac{P_2}{P_1}\right)^{((\kappa+1)/\kappa)}\right)(1 - C_c^2(d/D)^4)}{(1 - P_2/P_1)\left(1 - \left(\frac{P_2}{P_1}\right)^{(2/\kappa)} \cdot C_c^2(d/D)^4\right)} \right)$$

Next, the mass of air in the chamber is calculated from Eq. 9, which is based on the ideal-gas law. The term "chamber" is used here to mean not only the part corresponding to the so-called surge tank but all portions between immediately downstream of the throttle and the intake port.

$$Gb(k) = \frac{V}{RT} \cdot P(k) \qquad \text{Eq. 9}$$

where:
V: Chamber volume
T: Air temperature
R: Gas constant
P: Pressure

Therefore, the change delta Gb in the mass of air in the chamber in the current cycle can be obtained from the pressure change using Eq. 10.

$$\begin{aligned} \Delta Gb &= Gb(k) - Gb(k-1) = \frac{V}{RT} \cdot (P(k) - P(k-1)) \\ &= \frac{V}{RT} \cdot \Delta P(k) \end{aligned} \qquad \text{Eq. 10}$$

Figure 16:
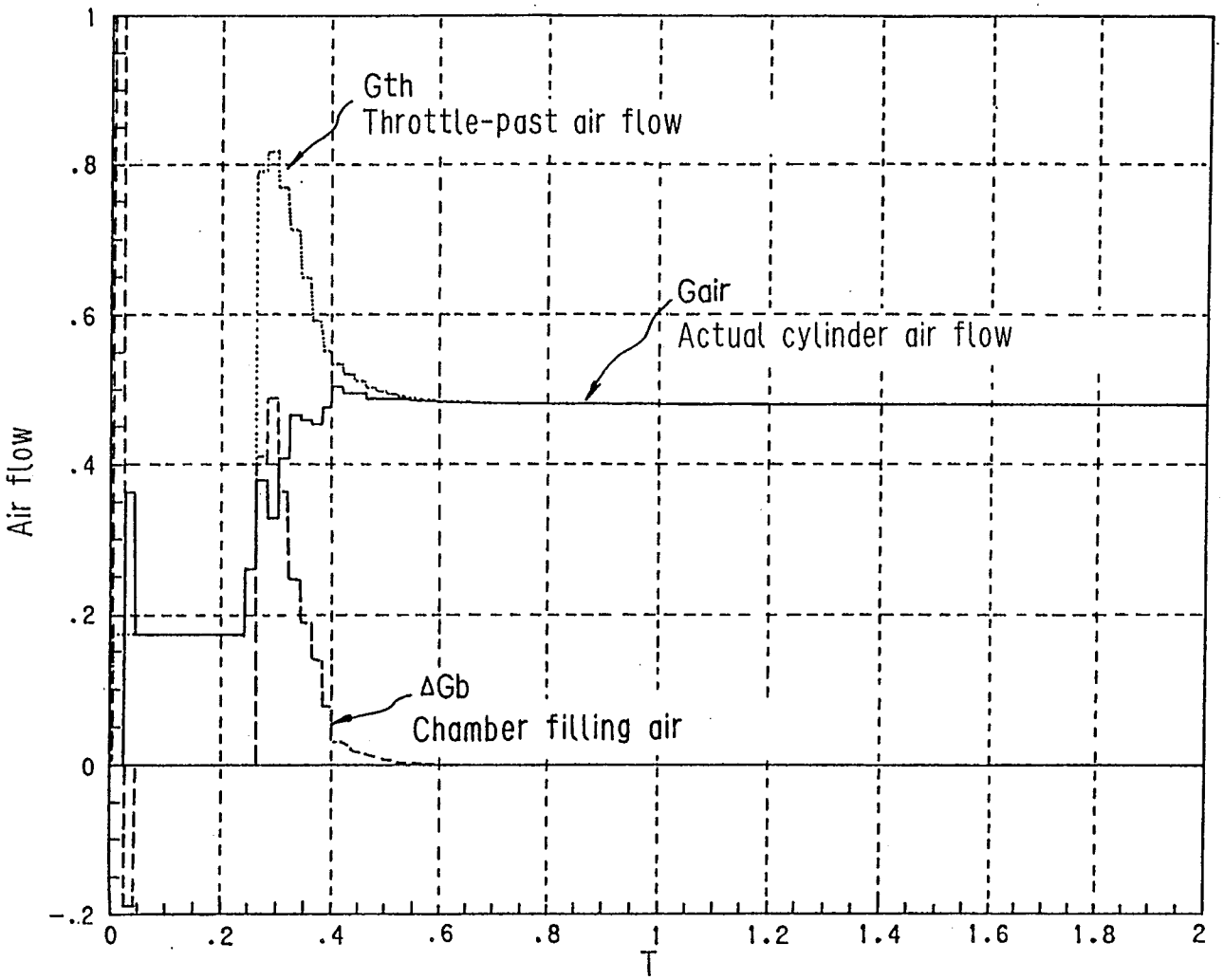
FIG. 16 is a view showing simulation results to the actual cylinder air flow estimated using the model of FIG. 15.

Specifically, under steady-state engine operating conditions it holds that Gth=Gair. On the other hand, under transient engine operation condition the reason that the manifold absolute pressure rises when, for example, the throttle valve is opened suddenly is that the chamber is full of air. This means that if the mass of air charged in the chamber and the mass of air that passed through the throttle valve are known, the mass of air inducted into the cylinder can be found. In other words, if it is assumed that, as is only natural, the mass of air charged in the chamber is not inducted into the cylinder, then the actual cylinder air flow Gair per time unit delta T can be expressed by Eq. 11, whereby it becomes possible to estimate the dynamic behavior of the actual cylinder air flow. FIG. 16 shows the results of simulation using this method.

$$Gair = Gth \cdot \Delta T - \Delta Gb \qquad \text{Eq. 11}$$

The results of a test regarding the foregoing will be set out. The testing apparatus used is shown schematically in FIG. 17.

Figure 18:
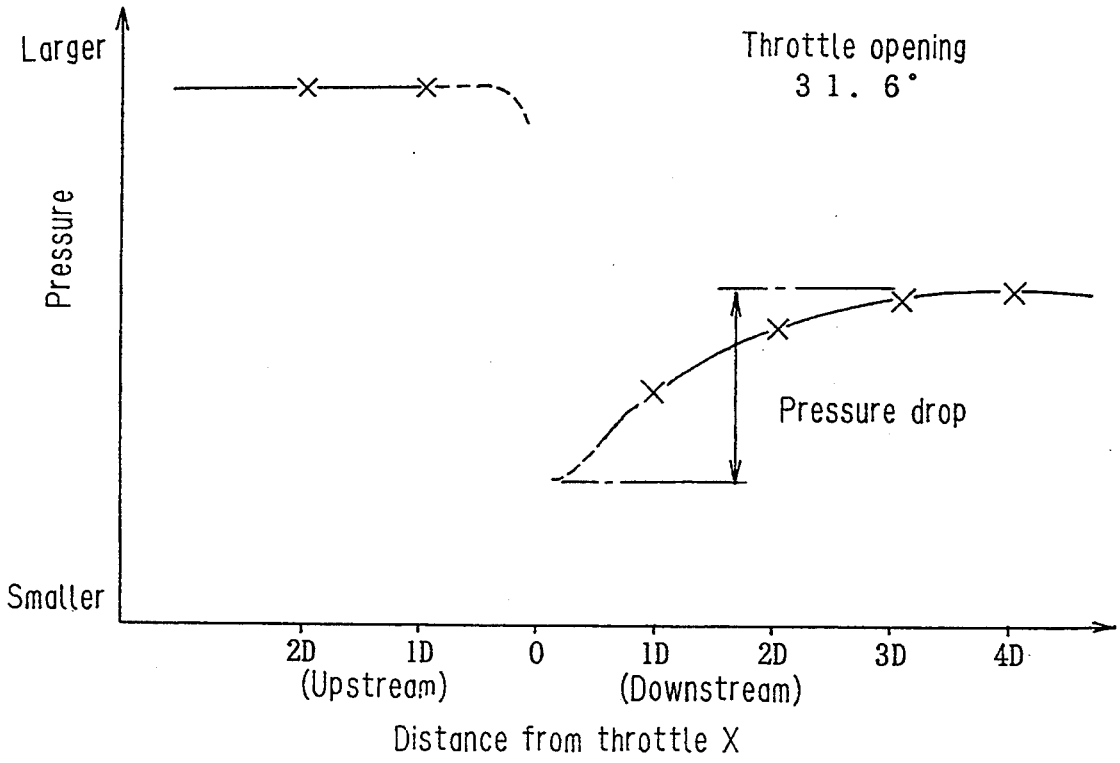
FIG. 18 is a view showing test results using the apparatus of FIG. 17.

The test was conducted by maintaining the throttle opening constant and measuring the change in pressures at upstream and downstream of the throttle when the air flow was varied. Regarding the upstream side of the throttle, the test was conducted for ten different throttle openings. Among these, the results for a throttle opening of 31.6 degrees are shown in FIG. 18. From these and the other test results it could be concluded as follows.

(1) Moving downstream from the throttle, the pressure drops at a distance of 1D to 2D (D: throttle bore diameter), recovers at 3D to 4D and then gradually decreases from thereon (owing to the contraction, swirling and separation of the flow caused by the throttle valve).

(2) It is necessary to calculate the throttle-pass air flow using the recovered pressure value because the pressure difference at upstream and downstream of the throttle appears larger than actual when measured in the pressure drop region.

It was further found that the pressure drops just before the throttle on the upstream side.

From the foregoing, it was concluded to be preferable to measure the pressure Pthdown ($P_2$ in Eq. 5) downstream of the throttle at a position in the pressure recovery region (i.e. about 3D (ideally 3D–4D) from the throttle valve) and to measure the pressure Pthup ($P_1$ in Eq. 5) upstream of the throttle at a position which is as close to the throttle valve as possible but which is unaffected by the throttle valve (i.e. about 1D or more) from the throttle valve. Since in this sense the pressure downstream of the throttle can be assumed equal to the chamber (surge tank) pressure, as will be explained further later one possible arrangement is to define the detection value of a pressure sensor installed in the surge tank as the pressure Pthdown downstream of the throttle.

Figure 19:
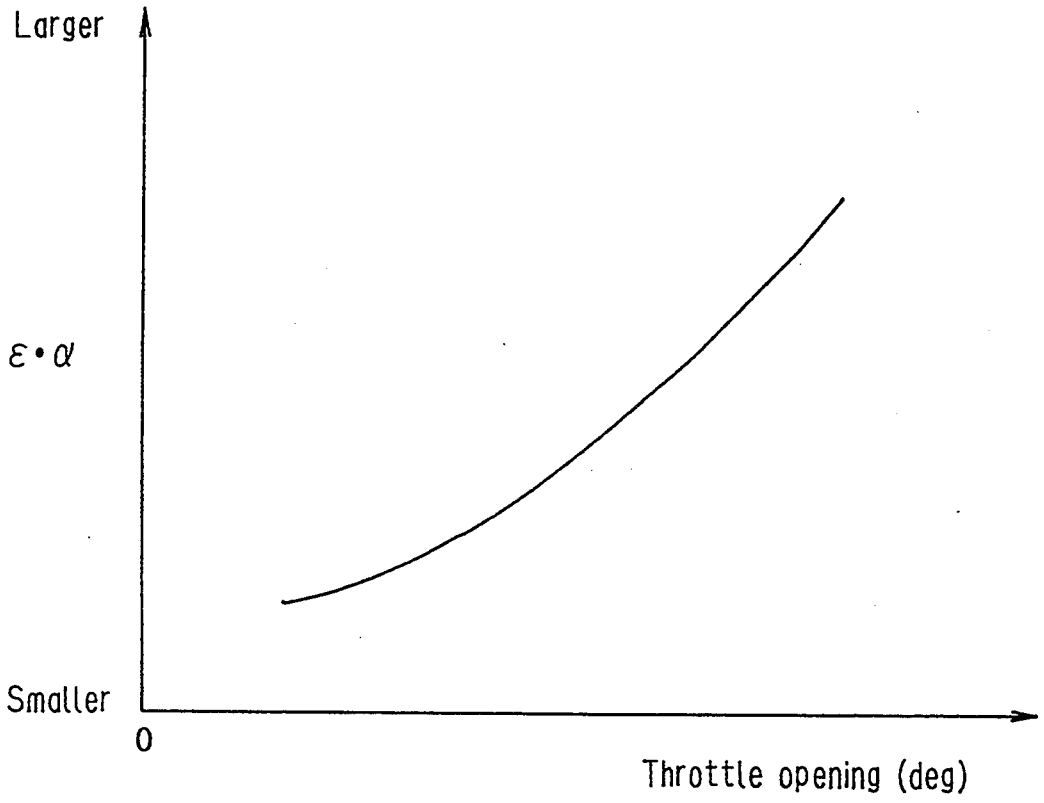
FIG. 19 is a view showing test results for identifying the flow rate coefficient with respect to throttle opening.
Figure 20:
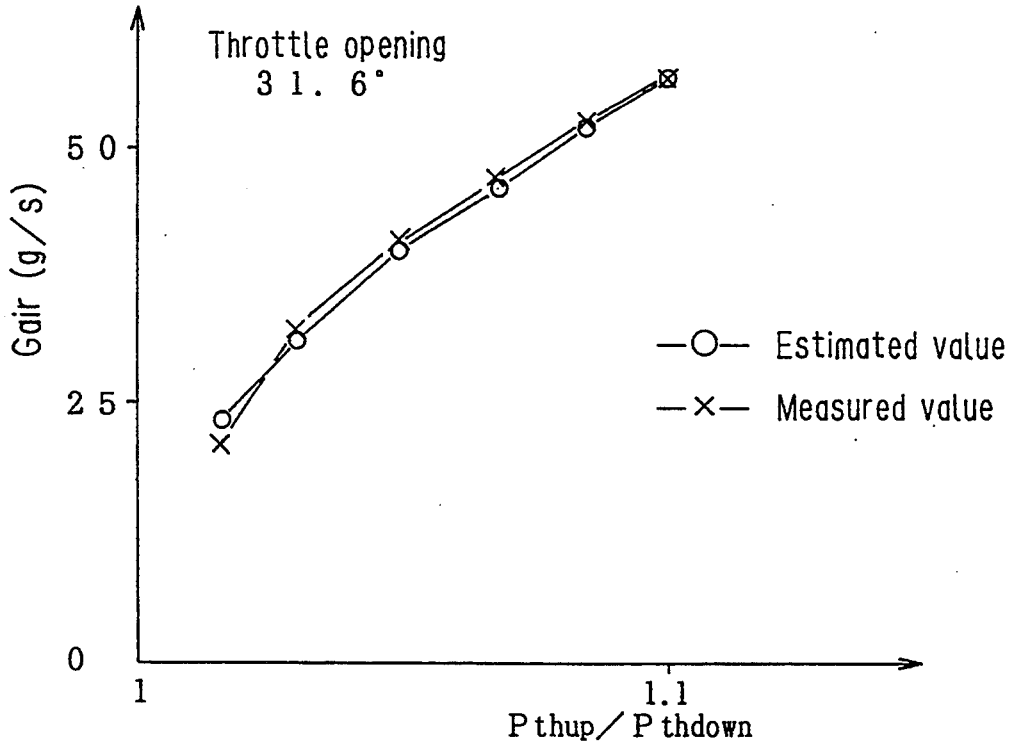
FIG. 20 is a view showing estimated values obtained by using the identification results of FIG. 19 and illustrated in contrast with measured values.

Taking the flow rate coefficient $\alpha$ and the correction coefficient epsilon to be unknown in Eq. 8, the product of the flow rate coefficient $\alpha$ and the correction coefficient epsilon was identified by the foregoing test (the parameter rho 1 was calculated from the barometric condition at the test). The identification was conducted by using the measured pressures across the throttle to calculate the mass flow rate passing the throttle Gth per unit time (the initial value of which was appropriately set), comparing the calculated value with the measured value, varying the product to bring the calculated and measured values into coincidence, repeating the foregoing to obtain the value involving minimum error and defining this value as the flow rate coefficient. The relationship between the product identified by this method and the throttle opening is shown in FIG. 19. The values estimated using the identified product are compared with the measured values in FIG. 20 (only for a throttle opening of 31.6 degrees).

Figures 21A, 21B, 21C:
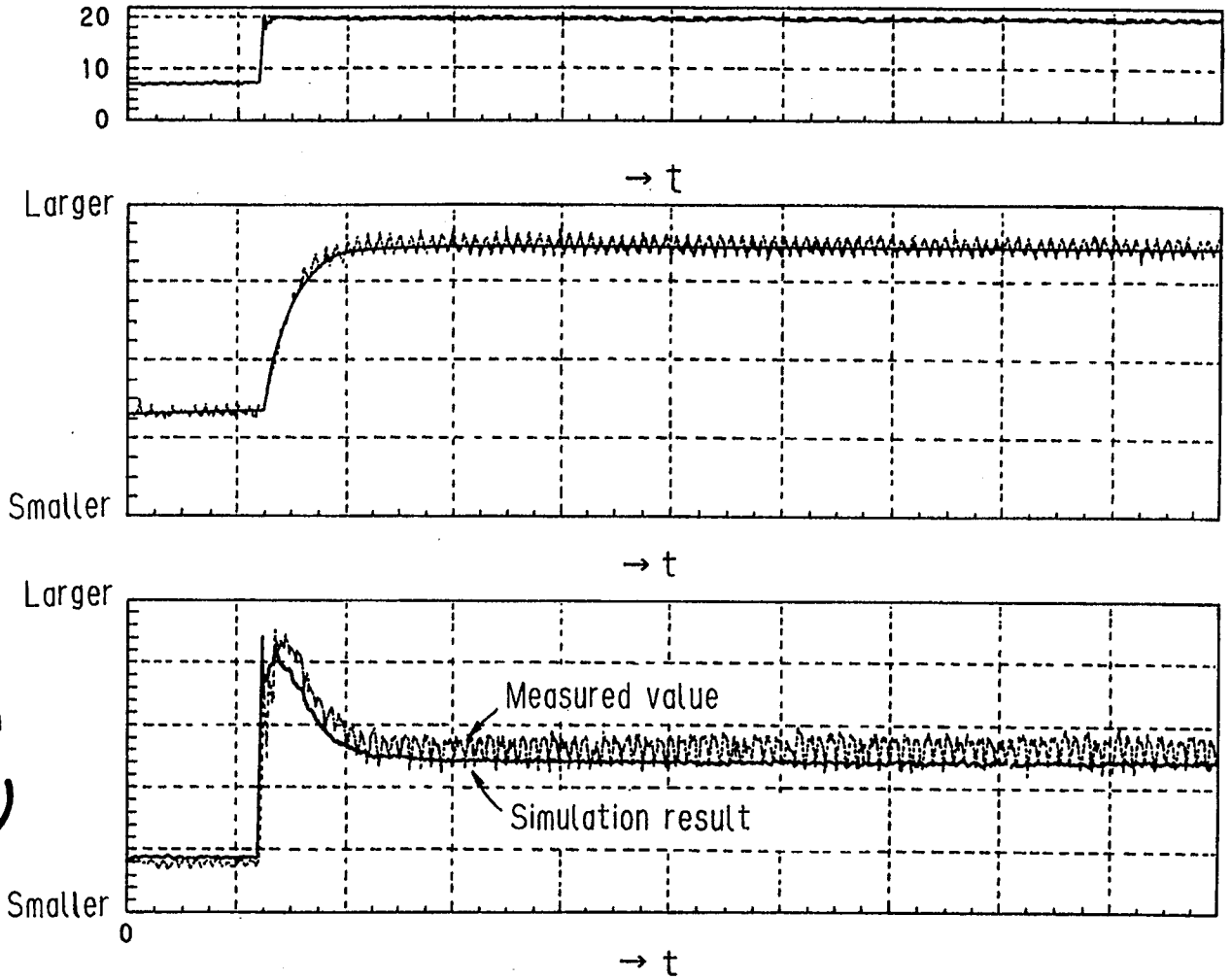
FIG. 21 is a view showing values obtained based on the model of FIG. 15 and illustrated in contrast with measured values.

FIG. 21 shows a comparison between measured values and the values calculated by simulation using the product of the flow rate coefficient and correction coefficient obtained in the foregoing manner and the values measured at positions 4D downstream and 1D upstream of the throttle valve. This figure shows the data obtained when the throttle opening was varied between 7 and 20 degrees. The value Pb is the value measured by manifold absolute pressure sensor and the value Gth is the value measured by an air flow meter.

In the data illustrated in FIG. 21, the values obtained through simulation almost coincided with the measured values. Continuing tests, however, it was found that they were not always equal at all situations.

Here, when rewriting Eq. 8, Eq. 12 will be obtained.

$$\begin{aligned} Gth &= \epsilon \cdot \rho_1 \cdot \alpha \cdot S \cdot \sqrt{\frac{2g \cdot (P_1 - P_2)}{\gamma_1}} \\ &= C \cdot S \cdot \rho_1 \cdot \sqrt{\frac{2g \cdot (P_1 - P_2)}{\gamma_1}} \\ &= A \cdot \rho_1 \cdot \sqrt{\frac{2g \cdot (P_1 - P_2)}{\gamma_1}} \\ &\approx A \cdot \rho_1 \cdot \sqrt{\frac{2g \cdot (Pa - Pb)}{\gamma_1}} \end{aligned} \qquad \text{Eq. 12}$$

where:

$C = \epsilon \cdot \alpha$ $A = C \cdot S$

S: Throttle projection area

A: Throttle effective opening area

Pa: Atmospheric pressure

Pb: Manifold absolute pressure

In Eq. 12, representing the product of the flow rate coefficient $\alpha$ and correction coefficient epsilon by a coefficient C, it was considered, as mentioned earlier, that the coefficient C could solely be determined from the profile of the throttle and dependent on its opening. After conducting tests repeatedly, however, it was found that the coefficient C could not be identified from the throttle opening alone, since a laminar flow or a turbulent flow happened depending on the rate of flow and the state of flow in the vicinity of wall changed by the occurrence of separation or swirling. Namely, it was confirmed that the coefficient C depended, not only on the throttle opening, but also on the flow rate.

Figure 22:
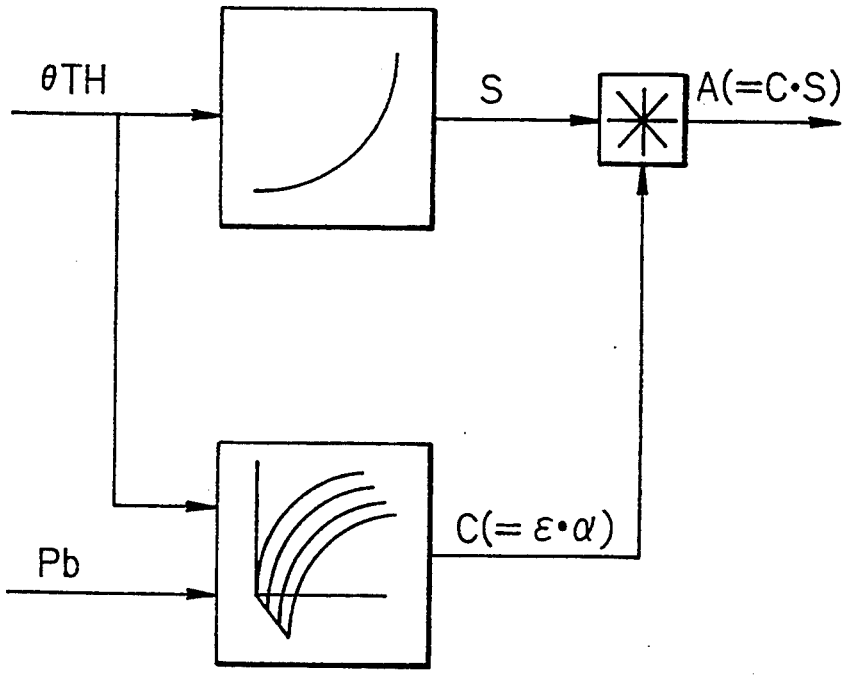
FIG. 22 is a block diagram showing calculation of a throttle effective opening area using the flow rate coefficient etc.

However, since the coefficient C must be determined in order to determine the flow rate itself, it is not possible to use, as a matter of fact, the flow rate as an input parameter. Instead, therefore, engine load, i.e. manifold absolute parameter Pb was used as a parameter indicative of the state of flow and good results were obtained. And, as illustrated in Eq. 12, the coefficient C thus obtained was multiplied to a throttle projection area S to determine throttle effective opening area A. As a result, it becomes possible to determine the throttle effective opening area A at all engine operating states with accuracy and to estimate the actual cylinder fuel flow precisely. FIG. 22 shows the configuration. Here, the throttle projection area is an area generated when throttle valve be projected in the direction parallel to the throttle bore's longitudinal direction.

Figure 23:
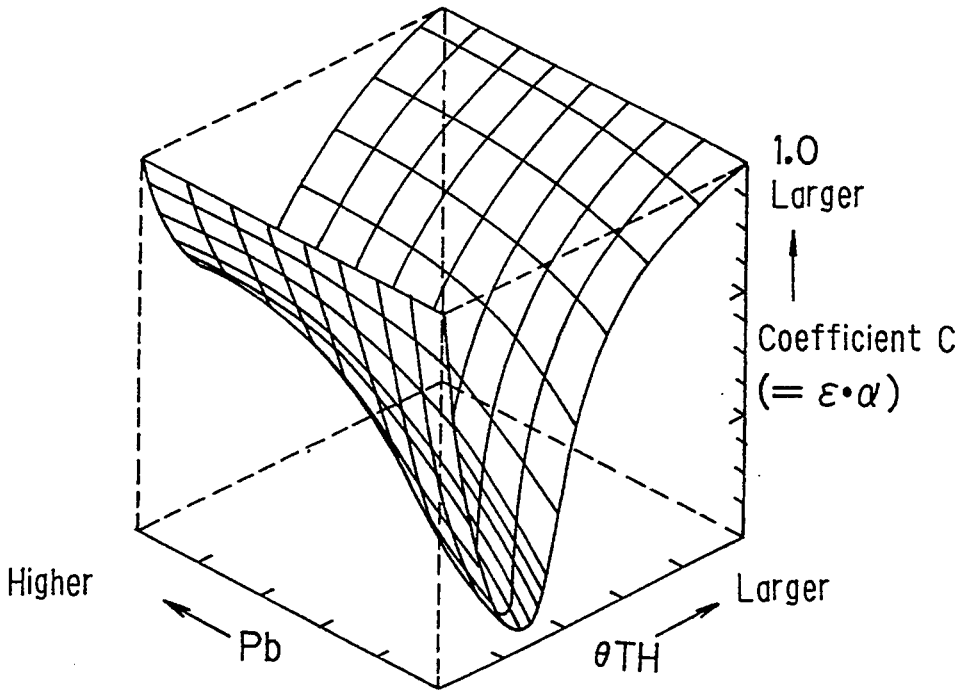
FIG. 23 is a view showing the characteristics of a mapped data of a coefficient including the flow rate coefficient set with respect to manifold absolute pressure and throttle opening.

It should be noted that the characteristics of the coefficient C with respect to throttle opening $\theta$TH and manifold absolute pressure Pb are determined in advance through experiments and is prepared as a mapped data in a computer memory as illustrated in FIG. 23. And at the time of preparing the mapped data, an interval between adjacent lattice points should be set to be decreasing with decreasing throttle opening. This is because the change of the coefficient C to the change of the throttle opening becomes large with decreasing throttle opening. Moreover, as illustrated in the same figure, the coefficient C should be set to be at or below 1.0. That is, it is difficult to imagine in the sense of physics that the effective opening area becomes greater than the projection area and the effective opening area is assumed to be increasing monotonously relative to the throttle opening. In addition, since the flow rate coefficient $\alpha$ and correction coefficient epsilon are both found to be related to manifold absolute pressure, they are treated as a whole as explained before. This brings a side effect that an error, if happened, will be lessened when compared with a case in which they are determined separately.

Furthermore, as shown in Eq. 12, the pressures P1 and P2 at upstream and downstream of the throttle are represented by atmospheric (barometric) pressure Pa and manifold absolute pressure Pb. And answers in the square root using the pressures are calculated in advance and stored as a mapped data similarly to that shown in FIG. 23. Moreover, as illustrated in FIG. 22, the throttle projection area S is obtained through a detected throttle opening $\theta$TH and the coefficient C is multiplied thereto to obtain the throttle opening area A. The relationship between the throttle opening $\theta$TH and the projection area S is accordingly determined in advance through experiments and stored in a table in a computer memory.

Figure 24:
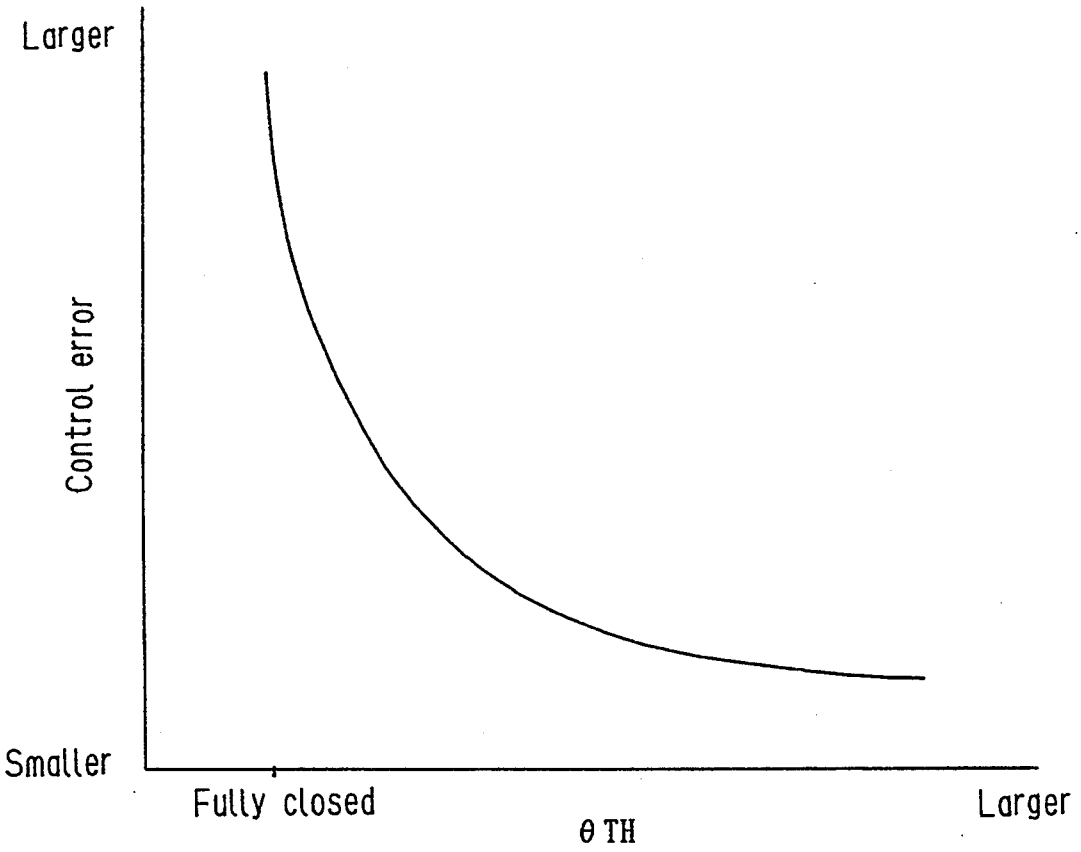
FIG. 24 is a view showing a control error with respect to throttle opening.
Figure 25:
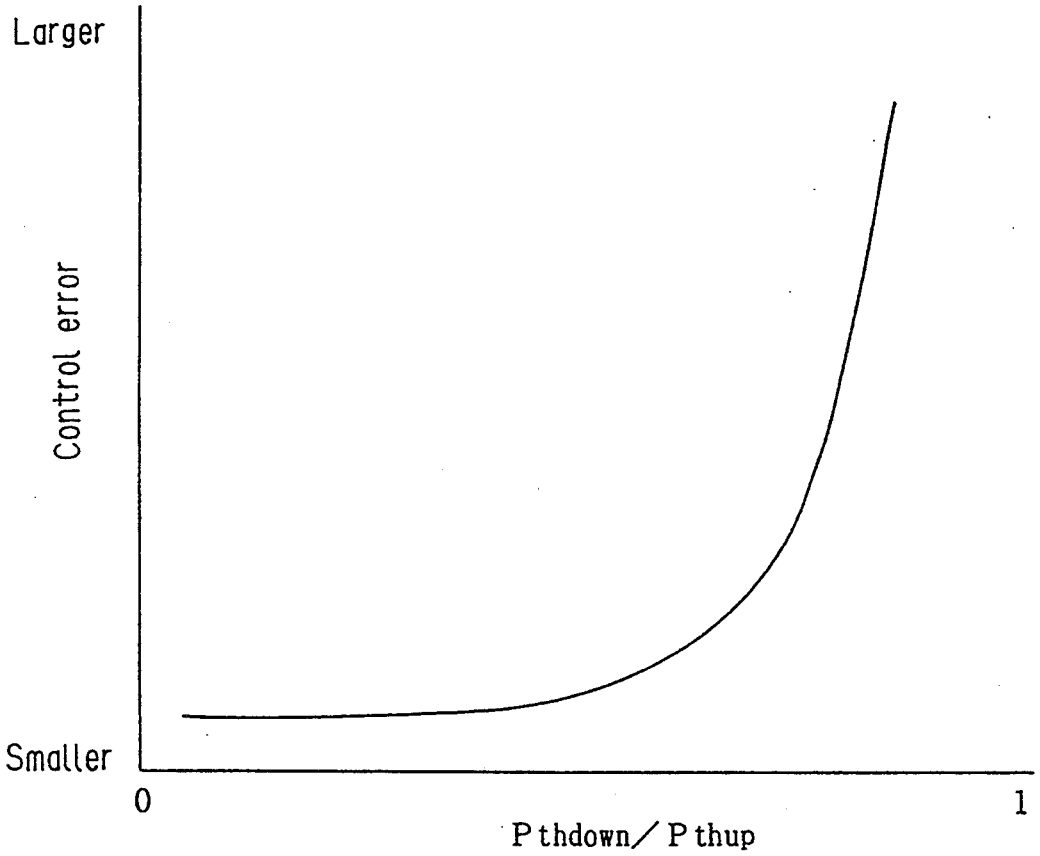
FIG. 25 is a view showing a control with respect to pressures at upstream and downstream of a throttle valve.

The relationship with the sensor's resolving power will next be discussed. FIG. 24 is based on measured data, the vertical axis representing the control error for a given measurement error and the horizontal axis representing throttle opening. The figure shows that the control error with respect to a given measurement error increases with decreasing throttle opening. It is therefore preferable to use a sensor whose measurement error decreases with decreasing throttle opening, i.e, one whose resolving power increases with decreasing throttle opening. FIG. 25 is based on measured data, the vertical axis again representing control error and the horizontal axis representing the ratio of the pressures on opposite sides of the throttle valve. It will be understood that it is preferable to use a manifold absolute pressure sensor whose resolving power increases with increasing load (toward the atmospheric pressure side indicated by 1 in the figure). In application to an actual engine, therefore, both, or at least one, of the throttle opening sensor and the manifold absolute pressure sensor should exhibit such preferable resolving power characteristics.

Some additional comments can be made regarding measurement of the air flow rate. First, the air flow rate is fixed at a prescribed value (e.g. 0.528) when the ratio of the pressures on opposite sides of the throttle valve is lower than a prescribed value since the flow velocity is equal to the sound velocity at such times. Further, for enhancing the calculation accuracy, the intake air temperature sensor is located near the throttle valve on the upstream side. In addition, it is preferable to install a hygrometer and use its output for correcting the air specific weight in Eq. 8.

It should further be noted that although the pressure Pb is detected in terms of absolute pressure, it is alternatively possible to detect by gauge pressure. Further, the coefficient C can be determined from the throttle opening $\theta$TH and a deviation (Pa−Pb) between the manifold absolute pressure Pb and the atmospheric pressure Pa or their ratio (Pb/Pa). Furthermore, the coefficient C may be determined from the throttle opening and any other environmental factor.

The detection of the air/fuel ratios at the individual cylinders will now be explained. From the points of cost and durability, multicylinder internal combustion engines are generally equipped with only a single air/fuel ratio sensor mounted at the exhaust gas confluence point. This makes it necessary to determine the air/fuel ratios at the individual cylinders from the air/fuel ratio at the confluence point. In this invention, therefore, the air/fuel ratio behavior at the convergence point is modeled and the air/fuel ratios at the individual cylinders are estimated by numerical calculation from the air/fuel ratio at the convergence point. Here, the air/fuel ratio sensor indicates not the so-called $O_2$ sensor, but a sensor which can detects an air/fuel ratio varying linearly with the oxygen concentration of the exhaust gas over a broad range extending from the lean direction to the rich direction. As this air-fuel ratio is explained in detail in the assignee's earlier Japanese patent application (Japanese Patent Application No. 3(1991)-169,456 filed Jun. 14, 1991), it will not be discussed further here.

First, the response delay of the air/fuel ratio sensor is approximately modeled as a first-order delay, the state equation for this is obtained and the result is discretized for the period delta T, giving Eq. 13. In this equation, LAF stands for the air/fuel sensor output and A/F for the input air/fuel ratio.

$$LAF(k+1)=\hat{\alpha}LAF(k)+(1-\hat{\alpha})A/F(k) \qquad \text{Eq. 13}$$

where:

$$\alpha=1+\alpha T+(\tfrac{1}{2}!)\alpha^2\Delta T^2+(\tfrac{1}{3}!)\alpha^3\Delta T^3+(\tfrac{1}{4}!)\alpha^4\Delta T^4$$

Figure 26:
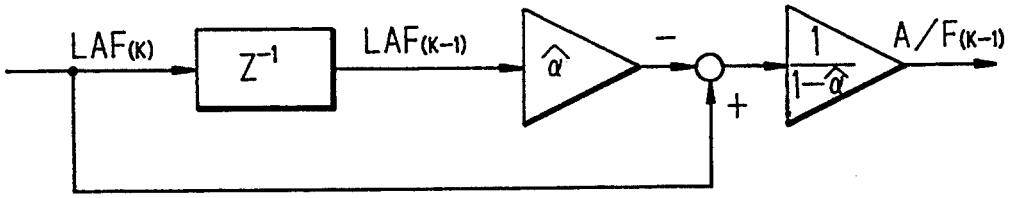
FIG. 26 is a block diagram showing an air/fuel ratio estimation used in the fuel metering control system of FIG. 1.

Z-transforming Eq. 13 to express it as a transfer function gives Eq. 14. In other words, as shown in FIG. 26, the air/fuel ratio in the preceding cycle (time k−1) can be obtained by multiplying the sensor output LAF in the current cycle (time k) by the inverse transfer function of Eq. 14.

$$t(z)=(1-\hat{\alpha})/(Z\,\hat{\alpha}) \qquad \text{Eq. 14}$$

Figure 27:
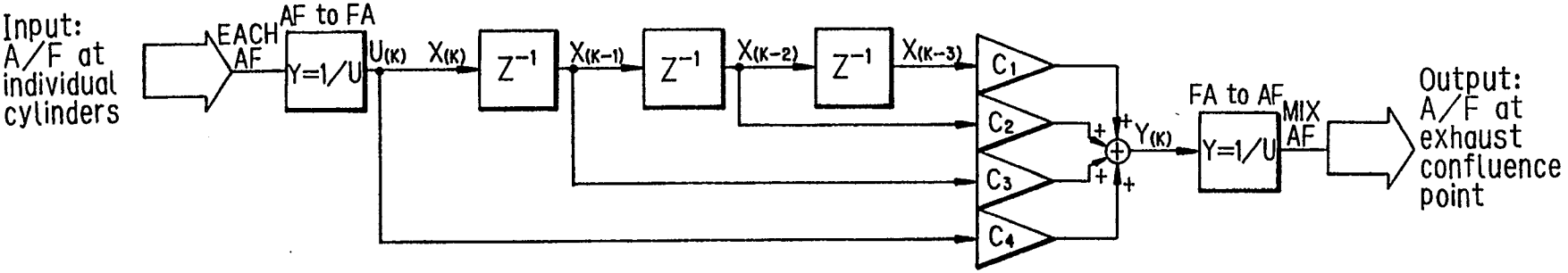
FIG. 27 is a block diagram showing a detailed configuration of an EXMN PLANT illustrated in FIG. 1.

An explanation will now be given regarding the method used to separate and extract the air/fuel ratios at the individual cylinders from the air/fuel ratio corrected for delay in the foregoing manner. First, the internal combustion engine exhaust system is modeled as shown in FIG. 27. This model corresponds to EXMN PLANT in FIG. 1. It should be noted that fuel is a controlled variable in this model (plant) so that a fuel/air ratio F/A is used here.

The inventors found that the air-fuel ratio at the exhaust confluence point could be expressed as an average weighted to reflect the time-based contribution of the air-fuel ratios of the individual cylinders. That is to say, it can be expressed in the manner of Eq. 15.

$$[\text{Confluence point } F/A](k) = C1 \cdot [F/A](k-3) + C2 \cdot [F/A](k-2) + C3 \cdot [F/A](k-1) + C4 \cdot [F/A](k) \quad \text{Eq. 15}$$

Eq. 16 expresses the air/fuel ratios at the individual cylinders in the form of a recurrence formula.

$$\begin{pmatrix} F/A(k-2) \\ F/A(k-1) \\ F/A(k) \\ F/A(k+1) \end{pmatrix} = \begin{pmatrix} 0100 \\ 0010 \\ 0001 \\ 1000 \end{pmatrix} \begin{pmatrix} F/A(k-3) \\ F/A(k-2) \\ F/A(k-1) \\ F/A(k) \end{pmatrix} + \begin{pmatrix} 0 \\ 0 \\ 0 \\ 1 \end{pmatrix} U(k) \quad \text{Eq. 16}$$

Since the input U (k) is unknown, if, assuming a four-cylinder engine, a recurrence formula is written for reproducing the air/fuel ratio once every 4 TDC (top dead center), the result becomes Eq. 17. The problem is thus reduced to the ordinary state equation such as expressed by Eq. 18.

$$\begin{pmatrix} F/A(k-2) \\ F/A(k-1) \\ F/A(k) \\ F/A(k+1) \end{pmatrix} = \begin{pmatrix} 0100 \\ 0010 \\ 0001 \\ 1000 \end{pmatrix} \begin{pmatrix} F/A(k-3) \\ F/A(k-2) \\ F/A(k-1) \\ F/A(k) \end{pmatrix} \quad \text{Eq. 17}$$

$$\begin{cases} X(k+1) = A \cdot X(k) \\ Y(k) = C \cdot X(k) \end{cases} \quad \text{Eq. 18}$$

Figure 28:
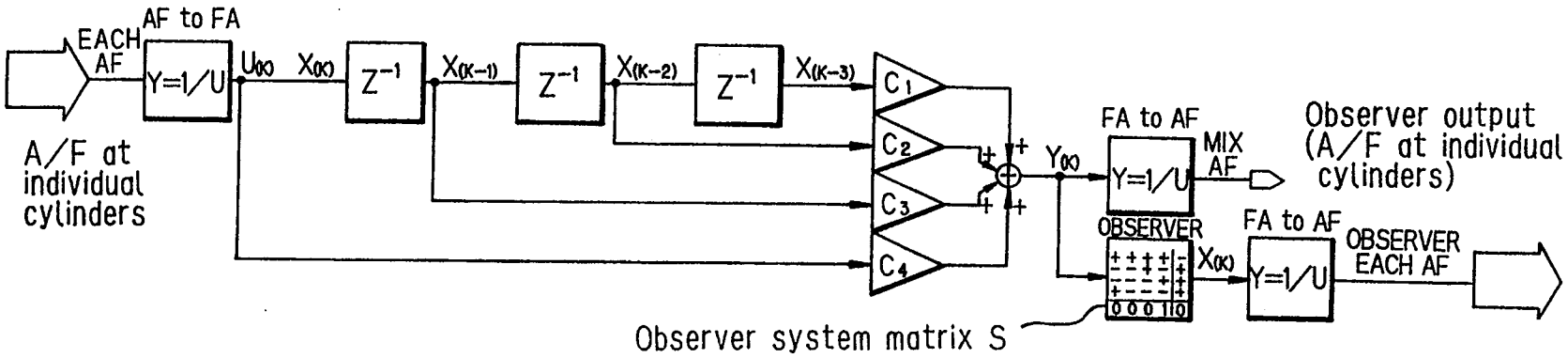
FIG. 28 is a block diagram showing the configuration of FIG. 27 incorporated with an observer.

Therefore, if the time-based degree of contribution C is known, it is possible, by designing a Kalman filter and configuring the observer shown in FIG. 28, to estimate X (k) at each instant from Y (k). In other words, an appropriate gain matrix is established for a state equation such as the foregoing, and consideration is given to X circumflex (k) of an equation such as Eq. 19.

$$\hat{X}(k+1) = (A - KC) \cdot \hat{X}(k) + K \cdot Y(k) \quad \text{Eq. 19}$$

If (A−KC) is a stable matrix, X circumflex (k) becomes X (k), and X (k) (air/fuel ratios at individual cylinders) can be estimated from Y (k) (air/fuel ratio at exhaust confluence point). As this was explained in detail in the assignee's earlier Japanese Patent Application No. 3(1991)-359,340 filed Dec. 27, 1991 (and filed in the United States on Dec. 24, 1992 under the number of 997,769 and in the EPO on Dec. 29, 1992 under the number of 92 31 1841.8), it will not be discussed further here.

A specific example of the application of the foregoing to an actual engine will now be explained.

Figure 29:
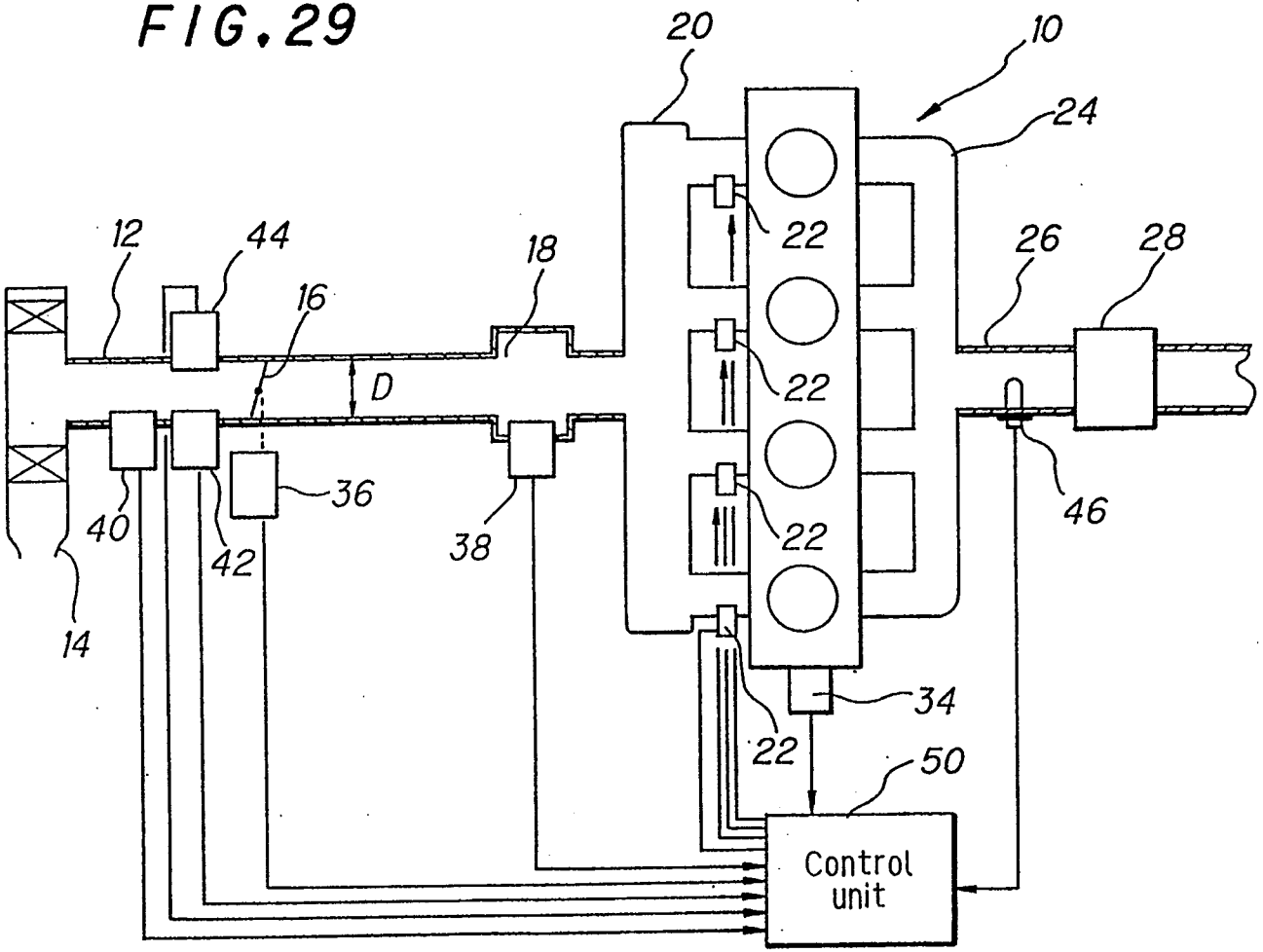
FIG. 29 is a view showing that the fuel metering control system is applied to an actual engine.

An overall view of the example is shown in FIG. 29. Reference numeral 10 in this figure designates an internal combustion engine. Air drawn in through an air cleaner 14 mounted on the far end of an air intake path 12 is supplied to first to fourth cylinders through a surge tank (chamber) 18 and an intake manifold 18 while the flow thereof is adjusted by a throttle valve 16. An injector 22 for injecting fuel is installed in the vicinity of the intake valve (not shown) of each cylinder. The injected fuel mixes with the intake air to form an air-fuel mixture that is ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 24, from where it passes through an exhaust pipe 26 to a three-way catalytic converter 28 where it is removed of noxious components before being discharged to the exterior.

A crank angle sensor 34 for detecting the piston crank angles is provided in a distributor (not shown) of the internal combustion engine 10, a throttle position sensor 36 is provided for detecting the degree of opening θTH of the throttle valve 16, and a manifold absolute pressure sensor 38 is provided for detecting the absolute pressure Pb of the intake air downstream of the throttle valve 16. On the upstream side of the throttle valve 16 are provided an atmospheric pressure sensor 40 for detecting the atmospheric (barometric) pressure Pa, an intake air temperature sensor 42 for detecting the temperature of the intake air and a hygrometer 44 for detecting the humidity of the intake air. The aforesaid air/fuel ratio sensor 46 comprising an oxygen concentration detector is provided in the exhaust system at a point downstream of the exhaust manifold 24 and upstream of a three-way catalytic converter 28, where it detects the air/fuel ratio of the exhaust gas. The outputs of the sensor 34 etc. are sent to a control unit 50. In the foregoing configuration, the atmospheric pressure sensor 40 for detecting the pressure upstream of the throttle is disposed at a position apart from the throttle valve 16 by at least 1D (D: diameter of the intake passage 12) and the manifold absolute pressure sensor 38 for detecting the pressure downstream of the throttle is disposed in the surge tank 18 and the surge tank 18 is disposed at least 3D apart from the throttle valve 16. The intake air temperature sensor 42 and the hygrometer 44 are disposed as close as possible to the throttle valve 16. The resolving power of the throttle position sensor 36 is at least 0.01 degree and that of the manifold absolute pressure sensor 38 at least 0.1 mmHg.

Figure 30:
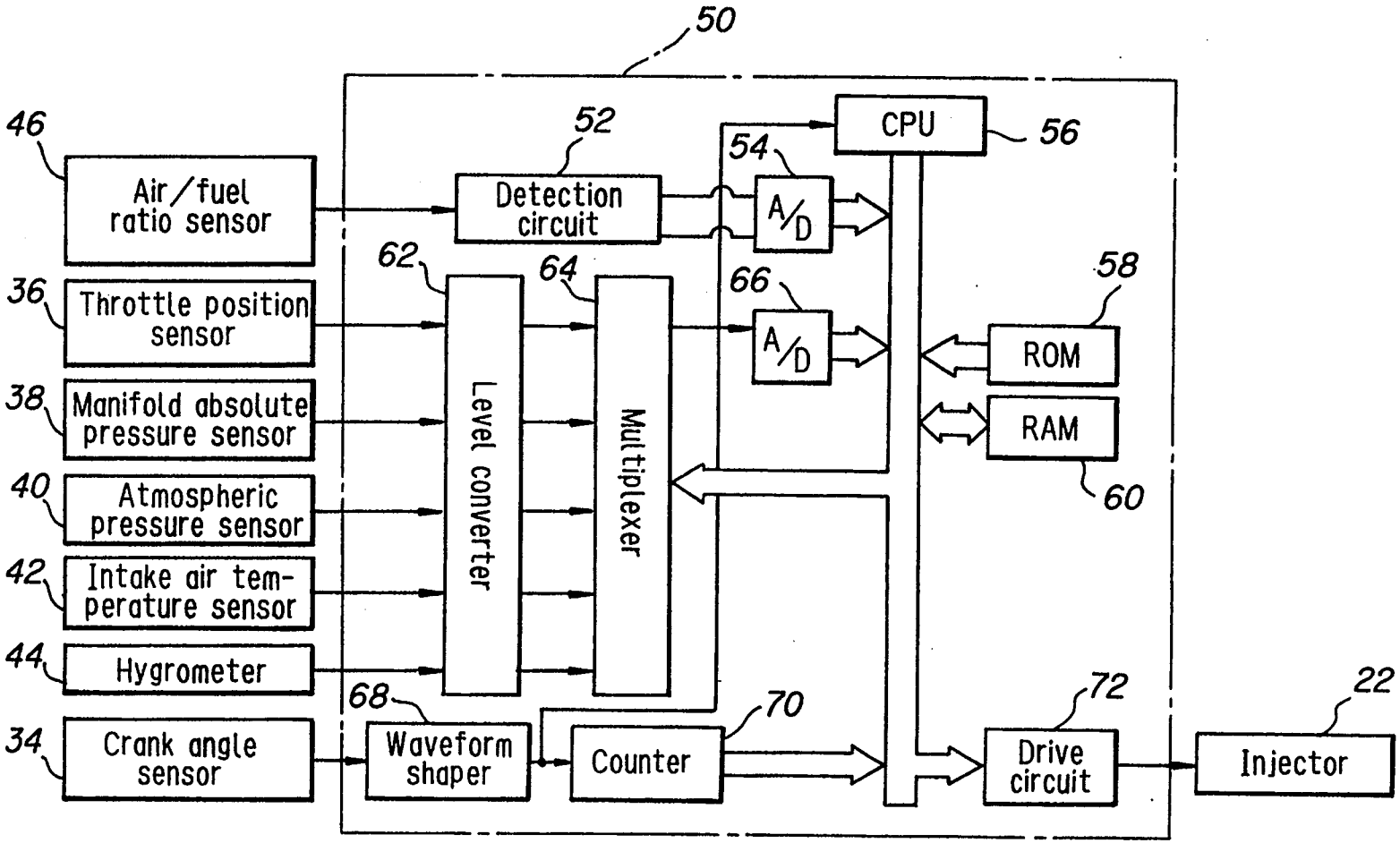
FIG. 30 is a block diagram showing the details of a control unit illustrated in FIG. 29.

Details of the control unit 50 are shown in the block diagram of FIG. 30. The output of the air/fuel ratio sensor 46 is received by a detection circuit 52 of the control unit 50, where it is subjected to appropriate linearization processing to obtain an air/fuel ratio (A/F) characterized in that it varies linearly with the oxygen concentration of the exhaust gas over a broad range extending from the lean side to the rich side, as was referred to earlier. The output of the detection circuit 52 is forwarded through an A/D (analog/digital) converter 54 to a microcomputer comprising a CPU (central processing unit) 56, a ROM (read-only memory) 58 and a RAM (random access memory) 60 and is stored in the RAM 58. Similarly, the analogue outputs of the throttle position sensor 36 etc. are input to the microcomputer through a level converter 62, a multiplexer 64 and a second A/D converter 66, while the output of the crank angle sensor 34 is shaped by a waveform shaper 68 and has its output value counted by a counter 70, the result of the count being input to the microcomputer. In accordance with commands stored in the ROM 58, the CPU 56 of the microcomputer computes control values in accordance with the adaptive control method explained earlier and drives the injectors 22 of the individual cylinders via a drive circuit 72.

Figure 31:
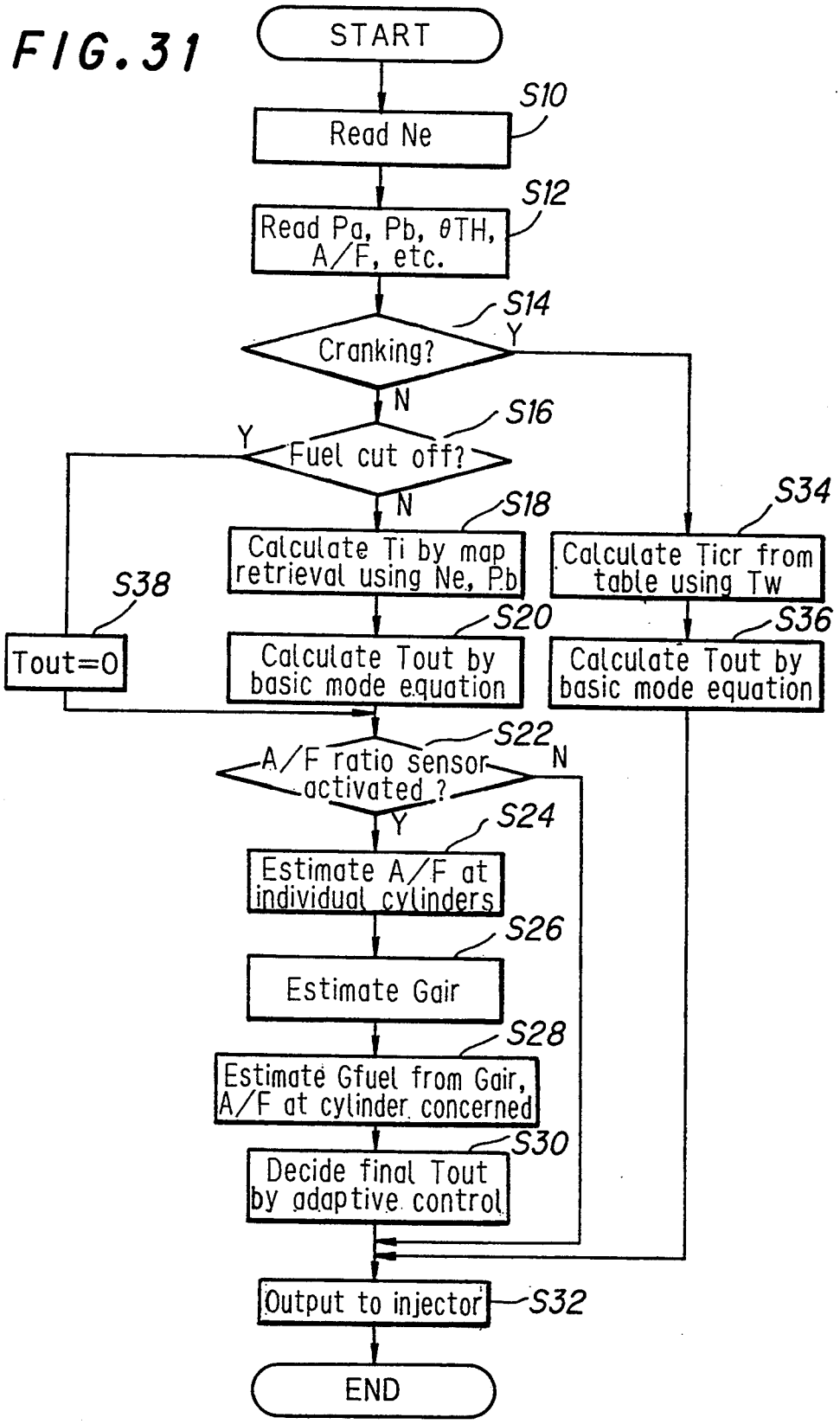
FIG. 31 is a flow chart showing the operation of the system of FIG. 29.

The operation of the control apparatus of FIG. 30 will now be explained with reference to the flow chart of FIG. 31.

The engine speed Ne detected by the crank angle sensor 34 is read in step S10. Control then passes to step S12 in which the atmospheric pressure Pa (same as pressure Pthup or P1 upstream of the throttle), the manifold absolute pressure Pb (same as pressure Pthdown or P2 downstream of the throttle), the throttle opening θTH, the air/fuel ratio A/F and the like detected by the atmospheric pressure sensor 40 etc. are read.

Program then passes to step S14 in which discrimination is made as to whether or not the engine is cranking, and if it is not, to step S16 in which a discrimination is made as to whether or not the fuel supply has been cut off. If the result of the discrimination is negative, program passes to step S18 in which the desired cylinder fuel flow Ti is calculated by map retrieval as shown in FIG. 1 using the engine speed Ne and the manifold absolute pressure Pb as address data, and to step $20 in which the fuel injection amount Tout is calculated in terms of injector's injection period in accordance with the basic mode equation. (The basic mode is a well-known method that does not use the aforesaid adaptive control.)

Program then passes to step S22 in which a discrimination is made as to whether or not activation of the air/fuel ratio sensor 46 has been completed, and if it has, to step S24 in which the air/fuel ratios of the individual cylinders are estimated by the method described in the foregoing, to step S26 in which the actual cylinder air flow Gair is estimated, to step S28 in which the actual cylinder fuel flow Gfuel is estimated, to step S30 in which the fuel injection amount Tout is finally determined in accordance with the aforesaid adaptive control, and to step S32 in which the value Tout is output to the injector 22 of the associated cylinder through the drive circuit 72. When it is found in step S14 that the engine is cranking, program passes through steps S34 and S36 for calculating the start mode control value. When step S16 finds that the fuel supply has been cut off, program passes to step S38 in which the value Tout is set to zero. If step S22 finds that the sensor has not been activated, program jumps directly to step S32 and the injector is driven by the basic mode control value.

In the foregoing configuration, the actual cylinder fuel flow is estimated with high precision based on the estimated air/fuel ratio at the individual cylinders and the parameters of the controller are adaptively controlled so as to make the actual cylinder fuel flow coincide with the desired value. As a result, it is possible to achieve high-precision adaptive control.

In addition, since a compensator with a transfer coefficient that is the inverse of that of the fuel adherence plant is connected in series with the fuel adherence plant, adaptive control to the desired value can be achieved while closely following any variation in the adherence state even in cases where the variation is due to a factor which varies rapidly with time such as the manifold absolute pressure. What is more, since a virtual plant incorporating the adherence compensator is postulated and when the transfer characteristic of the virtual plant is other than 1 or thereabout the adaptive controller is operated to have the inverse transfer characteristic, adaptive control that realizes the desired value can be achieved while closely following any variation that may occur owing to deviation of the preset characteristics from the actual characteristics as a result of aging or the like.

Although the invention was explained with reference to the configuration of FIG. 1, this is not the only configuration to which it can be applied.

Figure 32:
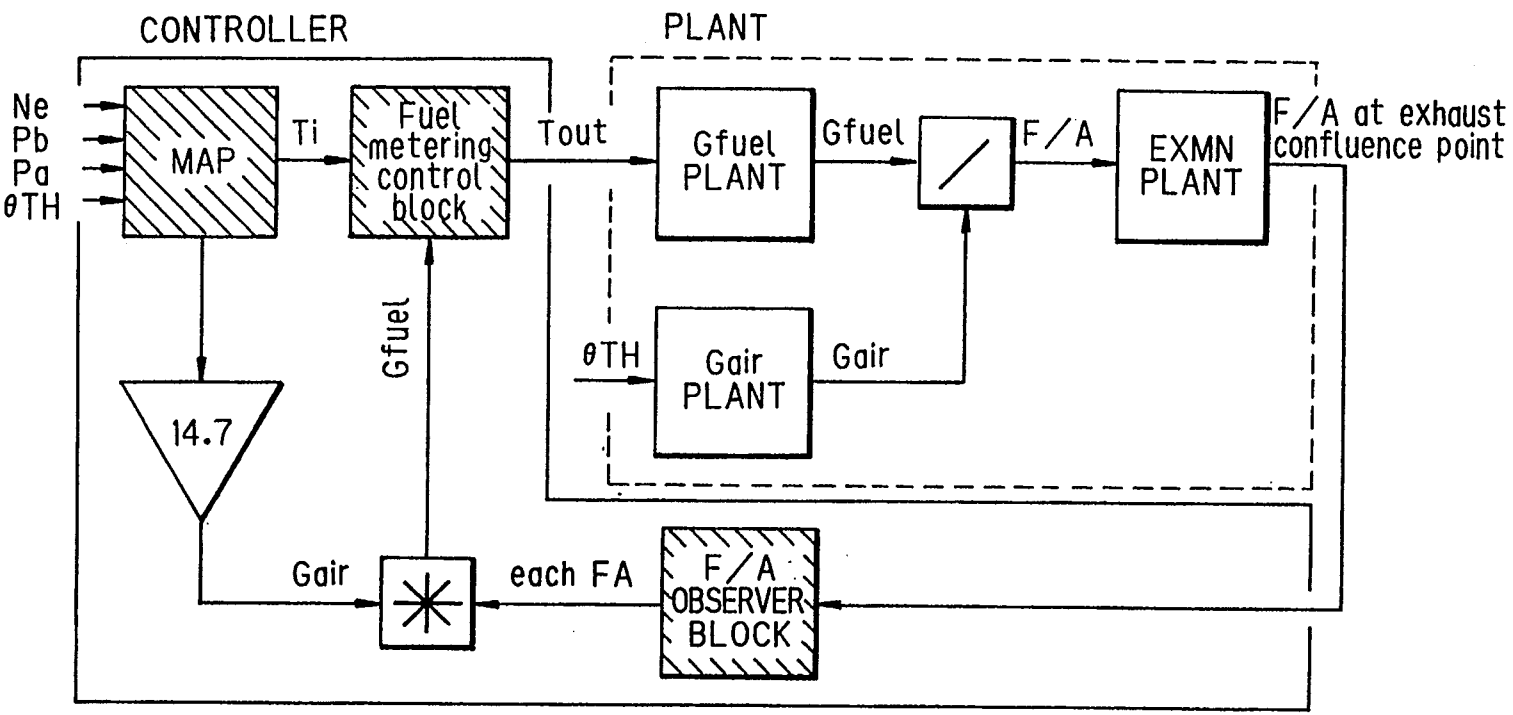
FIG. 32 is a block diagram showing a second embodiment of the invention.

FIG. 32 shows a second embodiment of the invention. The configuration of the second embodiment does not have the Gair model block for estimating the dynamic behavior of the actual cylinder air flow but instead estimates the actual cylinder air flow Gair by multiplying the mapped value by the stoichiometric air/fuel ratio 14.7 and absorbs the intake system behavior by conducting adaptive control. In other words, as was explained earlier, even error in the estimated actual cylinder air flow can be absorbed.

Figure 33:
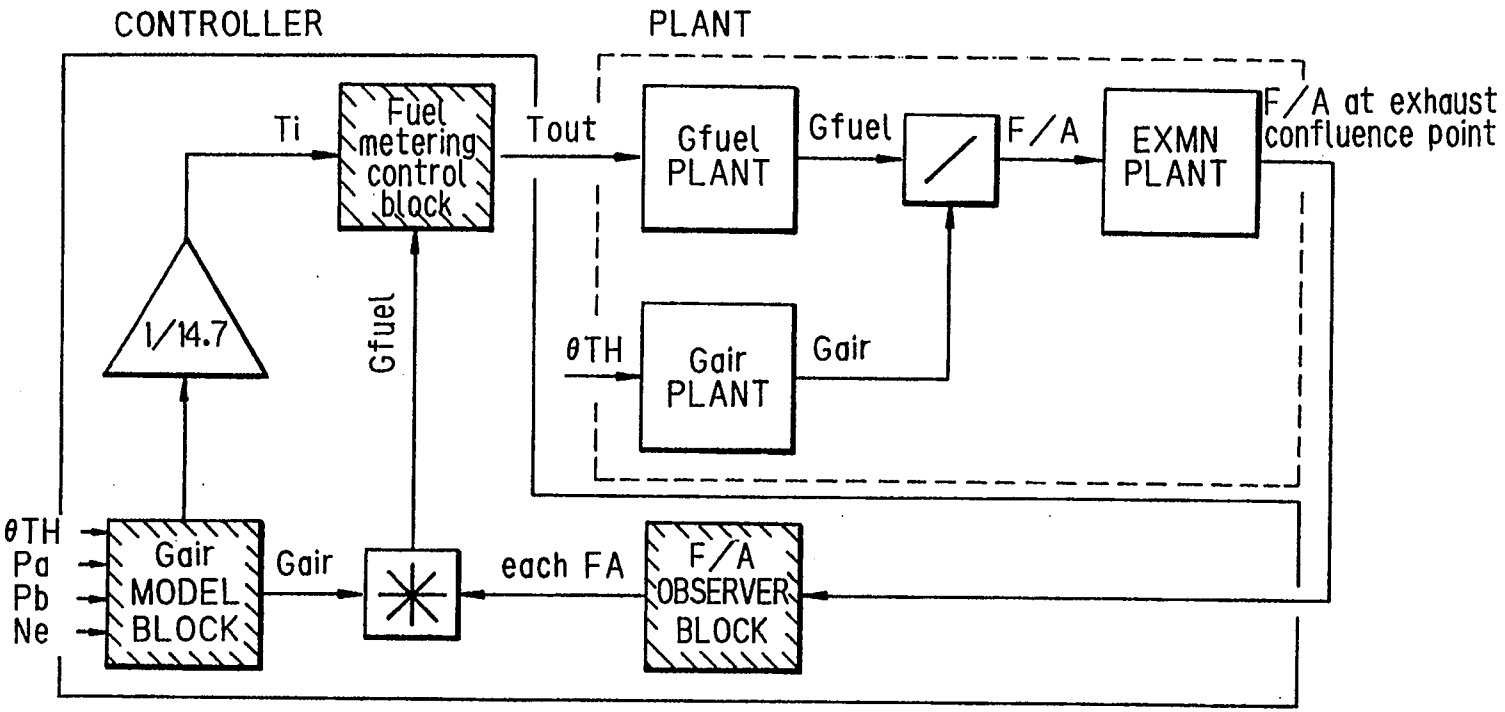
FIG. 33 is a view, similar to FIG. 32, but showing a third embodiment of the invention.

FIG. 33 shows a third embodiment of the invention, wherein the desired cylinder fuel flow Ti is not stored as a mapped data but is decided by multiplying the actual cylinder air flow Gair estimated by the Gair model block by 1/14.7.

Figure 34:
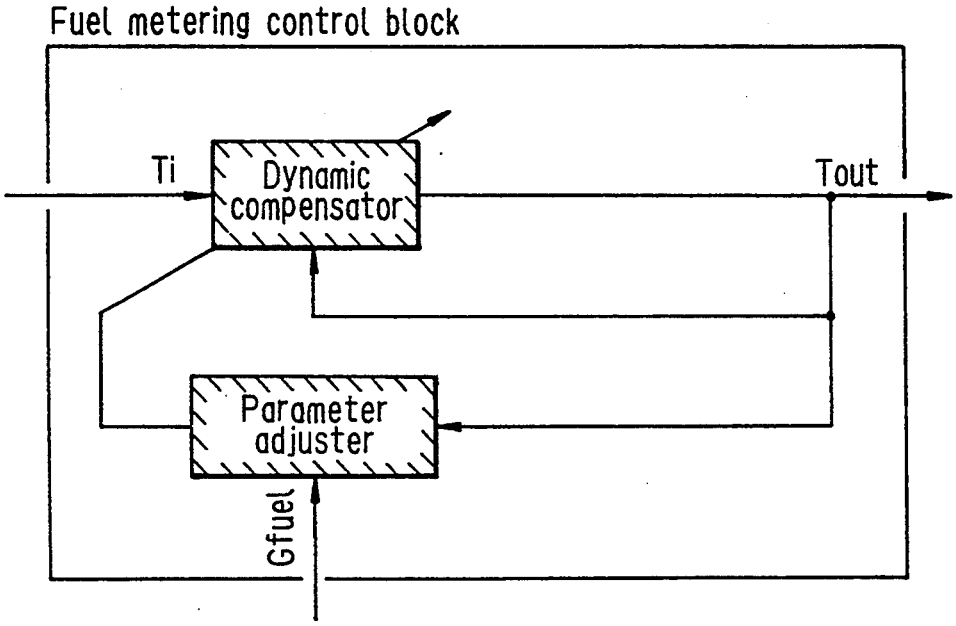
FIG. 34 is a view, similar to FIG. 2, but showing a fourth embodiment of the invention.
Figure 35:
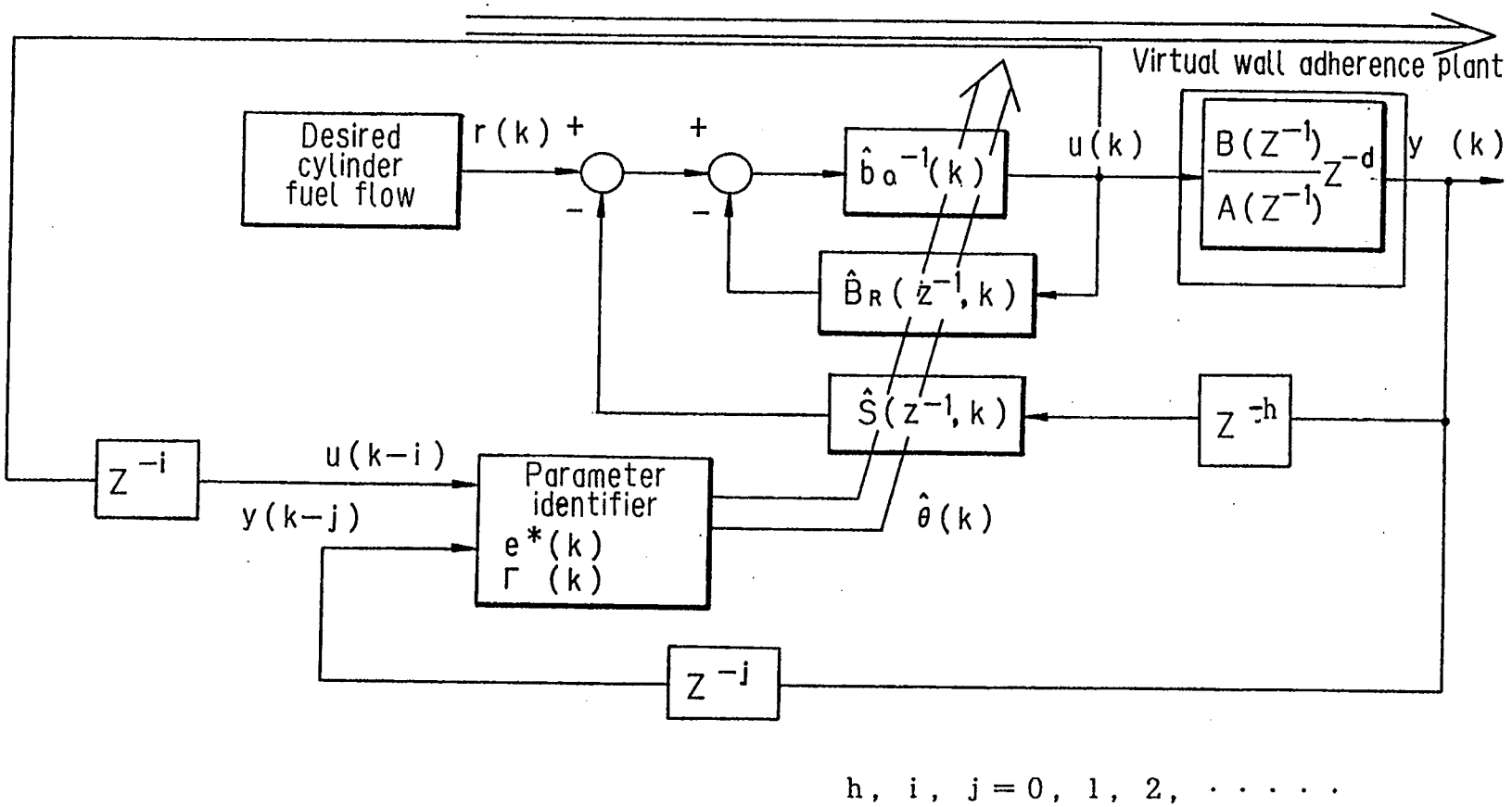
FIG. 35 is a view, similar to FIG. 8, but showing the fourth embodiment of the invention.

FIG. 34 and 35 show a fourth embodiment of the invention. As illustrated in FIG. 34, the wall adherence correction compensator is omitted in the configuration of the fourth embodiment in contrast to that in the first embodiment shown in FIG. 2. With the arrangement, however, when the transfer characteristic of the virtual plant becomes other than 1 or thereabout, the adaptive controller is also operated such that the transfer characteristic of the virtual plant and the adaptive controller becomes, as a whole, 1 or thereabout, i.e., the adaptive controller operates to have a transfer characteristics inverse thereto.

A second characteristic feature of the fourth embodiment is that dead time factors are inserted between the virtual plant and the parameter identifier. Namely, as mentioned earlier, there exist various lags in a fuel metering control such as a lag generated by an air/fuel ratio sensor's detection, a lag generated by sensor outputs' A/D conversion timing, a lag caused by fuel injection amount calculation, a lag due to outputting timing thereof etc. and what is worse, the lags may change depending on the states of engine or fuel metering control system. Therefore, the fourth embodiment aims to conduct a timing adjustment between the plant and the parameter identifier using dead time such that it can cope with the change of the lags.

For that purpose, the configuration illustrated in FIG. 8 is slightly modified in the fourth embodiment as shown in FIG. 35 wherein dead time factors are interposed between the virtual plant and the parameter identifier or the adaptive controller.

To be more specific, explaining parameter identification laws in the configuration of FIG. 35, the adaptive parameter 8 circumflex (k) can be expressed as Eq. 20 when using the method proposed by I. D. Landau et al. The identification error signal e star (k) and the gain matrix Γ (k) will be respectively expressed as Eq. 20 and Eq. 21.

$$\hat{\theta}(k) = \hat{\Theta}(k-1) + \Gamma(k-1)\xi(k-d)e^*(k) \qquad \text{Eq. 20}$$

$$e^*(k) = \frac{D(z^{-1})y(k) - \Theta^T(k-1)\xi(k-d)}{1 + \xi^T(k-d)\Gamma(k-1)\xi(k-d)} \qquad \text{Eq. 21}$$

Here, the orders of the θ circumflex (k) vector and the gain matrix Γ are solely determined from the order of the virtual plant and the order of the dead time (delay time factor) of the virtual plant. Accordingly, when dead time varies in response to the engine operating states, the orders of the vector and matrix used in the parameter identifier must be varied. Namely, the algorithm itself should be modified. That is not practical when realizing the system actually.

As an answer to the problem, the orders of the vector and matrix in the parameter identifier to be used for calculation is set to be possible maximum and dead time factors $z^{-h}$, $z^{-i}$ and $z^{-j}$ are inserted as illustrated in FIG. 35. As a result, if dead time actually becomes shorter than that, they can cope with various time lags existing between the input and output of the virtual plant. More specifically, at a high engine speed various time lags may become greater in total than a calculation cycle of the fuel metering control system so that the order of dead time could be d=4 at the maximum. The parameter identifier and adaptive controller should therefore be configured as d=4. On the other hand, the calculation cycle is relatively long at a low engine speed so that dead time becomes relatively short. If it is presumed that the order be d=2, the values h, i, j in FIG. 35 will then be adjusted such that h=2, i=0 and j=2. Consequently, dead time of the virtual plant's output will be apparently d=4 if viewed from the parameter identifier and adaptive controller.

Alternatively, the parameter identifier and adaptive controller can be configured in such a manner that dead time is set to be shorter than a possible maximum value. For example, assume that, when the order of dead time be d=4, the parameter identifier be configured to be prepared for a case in which the order of the plant's dead time is d=2. At such instance, if the dead time factors be configured as h=0, i=2 and j=0, the plant's output y(k) includes dead time order d=4 with respect to u(k−2), so that a difference therebetween will be 2. The identifier thus configured with its dead time order as quadratic can operate stably.

With the arrangement, since no time error occurs between the desired cylinder fuel flow and the plant output indicative of the actual cylinder fuel flow even during transient engine operating state, an air/fuel ratio can be converted to a desired value. Here, it should be noted that, in order to cope with various time lags existing between the plant's input and output or their variations, dead time can be provided to the plant's input and output in an appropriate manner other than that mentioned above.

Figure 36:
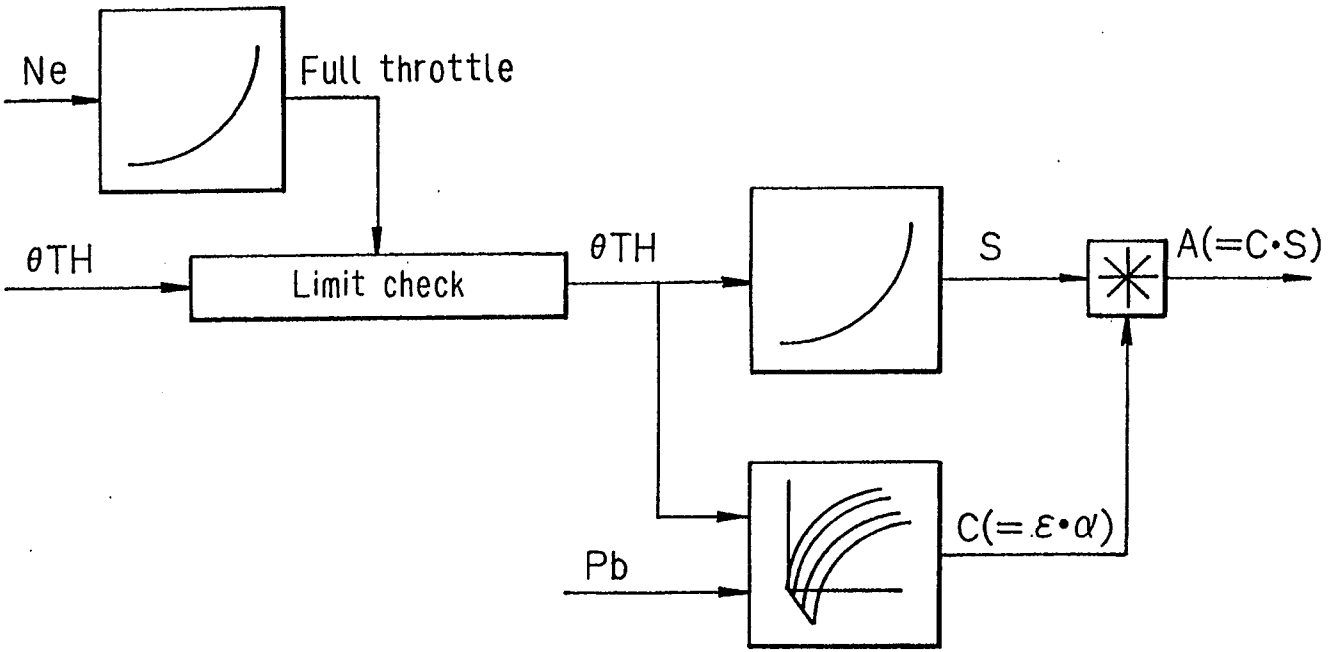
FIG. 36 is a view, similar to FIG. 22, but showing a fifth embodiment of the invention.

FIG. 36 is a view similar to FIG. 22, but shows a fifth embodiment of the invention relating to the determination of the coefficient C used in estimating the actual cylinder fuel flow Gair.

Figure 17:
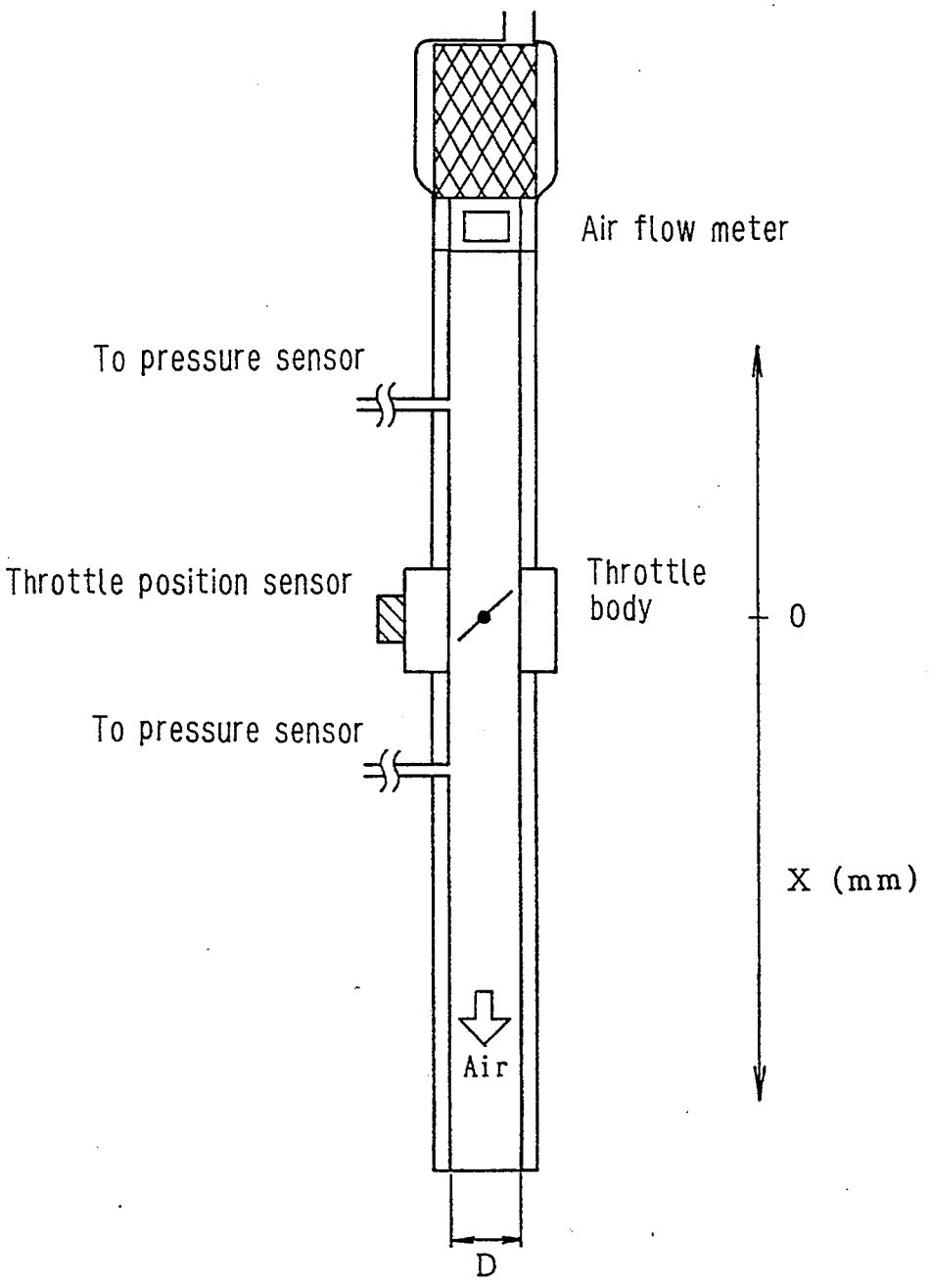
FIG. 17 is a view showing a testing apparatus to be used for the estimation.

When using the testing apparatus illustrated in FIG. 17, the throttle effective opening area increases with increasing throttle opening. In the actual engine such as shown in FIG. 29, however, there exists a critical value at a certain level at which the effective area becomes maximum. In other words, when viewing the engine air intake system as a whole, resistance at the intake port or the air cleaner becomes greater so that the valve does not function as a throttle. Since an engine is a kind of pump, it has a fully operated area at which no more air will be inducted even if the throttle valve is opened more. At such a fully opened area, if the effective opening area obtained from the testing apparatus of FIG. 17 is used in the calculation on an actual engine, a correct air flow will not be obtained. At the fully opened area, the critical value should therefore be used. Since the critical value should separately be determined from individual engine speeds as experienced in the case of the full throttle area, each throttle position corresponding to the fully opening area is obtained as the critical value for respective engine speeds and stored as a table data. A detected throttle opening is then compared with the critical value at the engine speed concerned and if the detected value is found to exceed the critical value, the detected value is replaced with the critical value, and the throttle effective opening area is calculated using the replaced critical value. FIG. 34 illustrates this.

Further, it should be noted that the cylinder air flow estimation was described in the first and fifth embodiments with reference to the fuel metering control using the adaptive control. This technique is applicable not only to the control disclosed herein but also to ordinary control of fuel metering or to ignition timing control.

Furthermore, in the embodiments described in the foregoing a single air/fuel ratio sensor is used for estimating the air/fuel ratios at the individual cylinders. The invention is not limited to this arrangement, however, and it is alternatively possible provide an air/fuel ratio sensor at each cylinder for directly detecting the air/fuel ratio at the individual cylinders.

While the invention has thus been shown and described with reference to the specific embodiments. However, it should be noted that the invention is in no way limited to the details of the described arrangements, changes and modifications may be made without departing from the spirit and scope of the invention as set forth in the following claims.

What is claimed is:

1. A system for controlling fuel metering in a multi-cylinder internal combustion engine, comprising:

a plurality of engine operation detecting sensors;

a microprocessor means, said microprocessor means being programmed to operate to determine a desired cylinder fuel flow in response to operating states of said engine;

determine an actual cylinder air flow;

determine an actual cylinder fuel flow for individual cylinders of said engine;

establish a wall adherence correction compensator model which compensates behavior of fuel adhering to an air intake passage of said engine;

establish an adaptive controller model for additionally correcting said wall adherence correction compensator model based upon feedback of a parameter which is output by said adaptive controller model and based upon said actual cylinder fuel flow to determine a fuel injection amount such that said actual cylinder fuel flow coincides with said desired cylinder fuel flow for said individual cylinders of said engine; and at least one injector for injecting fuel into said individual cylinders according to said fuel injection amount determined by said microprocessor.

2. A system according to claim 1, wherein said actual cylinder fuel flow is determined based on said actual cylinder air flow at a combustion cycle at or earlier than a last combustion cycle and an air/fuel ratio at the same combustion cycle.

3. A system according to claim 1, wherein one of said plurality of engine operation detecting sensors is an air/fuel ratio sensor and wherein said air/fuel ratio is determined through an output of said air/fuel ratio sensor installed at a confluence point of an exhaust section of said multi-cylinder internal combustion engine, by deriving means for deriving a behavior of said exhaust system in which X(k) is observed from a state equation and an output equation in which an input U(k) indicates an air/fuel ratio of an air and fuel mixture supplied to each cylinder of said plurality of cylinders and an output Y(k) indicates an air/fuel ratio value by said air/fuel ratio sensor at said confluence point of said exhaust system as $$X(k+1)=AX(k)+BU(k)$$

$$Y(k)=CX(k)+DU(k)$$

where A, B, C and D are coefficients from matrices dependent on the number of said plurality of cylinders, assuming means for assuming said input U(k) as a predetermined value to establish an observer expressed by an equation using said output Y(k) as an input in which a state variable X indicates said air/fuel ratio at each cylinder as $$\hat{X}(K+1)=(A-KC)\hat{X}(k)+Y(k)$$

where K is a gain matrix; and determining means for determining said estimated air/fuel ratio of said air and fuel mixture being supplied to each cylinder of said plurality of cylinders from said state variable X.

4. A system according to claim 1, wherein said actual cylinder air flow is determined by:

air flow determining means for assuming a throttle provided at an air intake passage of said engine as an orifice to establish a fluid dynamic model and based on said model, determining air flow passing therethrough at least using detected pressures upstream and downstream of said throttle;

air amount determining means for determining air filling a chamber in said passage extending from said throttle to an intake port of said cylinder using ideal-gas law;

difference determining means for determining change of said air in said chamber from pressure change in said chamber; and cylinder air flow estimating means for estimating a cylinder air flow by subtracting said change of said air in said chamber from said throttle passing air flow.

5. A system according to claim 1, wherein said wall adherence correction compensator model is placed ahead of said engine in terms of transfer function and when an engine model incorporating said wall adherence correction compensator model and said engine is postulated, said adaptive controller model operates such that said actual cylinder fuel flow output from said engine model coincides with said desired cylinder fuel flow.

6. A system according to claim 1, wherein a dead time parameter is additionally provided.

7. A system according to claim 1, wherein said parameter of said adaptive controller model operates using at least one of a variable gain method and a constant trace method.

8. A system according to claim 1, wherein a transfer function parameter of said wall adherence correction compensator model is determined in response to operating states of said engine in accordance with a predetermined characteristic.

9. A system according to claim 8, wherein said operating states of said engine include at least one of manifold pressure, engine speed and engine coolant water temperature.

10. A system according to claim 6, wherein said dead time parameter is additionally provided to said adaptive controller model.

11. A system according to claim 6, wherein an order of said dead time parameter is varied in response to at least one of operating states of said engine and said fuel metering control system itself.

12. A system according to claim 6, wherein said dead time parameter is additionally provided between said adaptive controller model and said engine model.

13. A method for estimating cylinder air flow in an internal combustion engine having an air intake passage provided with a throttle valve, a plurality of engine operation detecting sensors, a microcomputer and a plurality of injectors, said method comprising the steps of:

determining air flow passing through said throttle valve in response to throttle opening based upon a coefficient, throttle projection area, air density at throttle's upstream side, gravitational acceleration, air specific weight on throttle's upstream side, pressure on throttlers upstream side, pressure on throttle's downstream side;

determining a quantity of air filling a chamber in said passage extending from said throttle valve to an intake port of said cylinder using ideal-gas law;

determining a change of said quantity of air in said chamber from change in pressure in said chamber;

estimating a cylinder air flow based upon said change of said air in said chamber and said throttle passing air flow; and injecting fuel into individual cylinders of the engine through at least one injector based upon said estimated cylinder air flow.

14. A method according to claim 13, wherein said pressure upstream of said throttle valve is measured at a position away from said throttle valve at least by 1D when a diameter of said air intake passage is defined as D.

15. A method according to claim 13, wherein said pressure downstream of said throttle valve is measured at a position away from said throttle valve at least by 3D when a diameter of said air intake passage is defined as D.

16. A method according to claim 13, wherein said pressure downstream of said throttle valve is determined from said pressure at said chamber.

17. A method according to claim 13, wherein resolving power of a sensor for measuring throttle opening is set to be increased with decreasing throttle opening.

18. A method according to claim 13, wherein resolving power of a sensor for measuring said pressure downstream of said throttle valve is increased with increasing pressure.

19. A method according to claim 13, wherein said coefficient is determined from throttle opening and a value indicative of engine load at least one among manifold pressure, a deviation between manifold pressure and atmospheric pressure and a ratio of manifold pressure to atmospheric pressure.

20. A method according to claim 19, wherein said coefficient is determined from throttle opening and engine load in advance and is stored as mapped data in a computer memory.

21. A method according to claim 20, wherein an interval between adjacent lattice points in said mapped data is set to be smaller with decreasing throttle opening.

22. A method according to claim 19, wherein a critical throttle opening at which engine load becomes maximum is determined with respect to engine speed and when a detected throttle opening exceeds said critical throttle opening, said detected value is replace with said critical value.

23. A method according to claim 19, wherein said coefficient includes at least flow rate coefficient.

24. A method according to claim 13, wherein said pressures upstream and downstream of said throttle valve are respectively represented by atmospheric pressure and manifold pressure and said determined air flow passing through said throttle valve is determined in advance and stored as mapped data in a computer memory.

25. A system for controlling fuel metering in a multi-cylinder internal combustion engine comprising.: a plurality of engine operating detecting sensors;

a microprocessor means, said microprocessor means being programmed to operate to determine a desired cylinder fuel flow at a combustion cycle at or earlier than a last combustion cycle in response to operating states of said engine;

determine an actual cylinder air flow at a combustion cycle at or earlier than a last combustion cycle;

determine an actual cylinder fuel flow for individual cylinders at a combustion cycle at or earlier than a last combustion cycle by dividing said actual cylinder air flow by an air/fuel ratio in said cylinder at the same combustion cycle;

establish an adaptive controller model for controlling an engine model which simulates behavior of fuel adhering to an air intake passage of said engine;

establish a wall adherence correction compensator model having a transfer characteristic inverse to that of said engine model in series to said engine model;

adjust a parameter of said transfer characteristic of said wall adherence correction compensator model in accordance with a characteristic predetermined in response to the operating states of said engine;

wherein said wall adherence correction compensator model is presumed to be a simulated model and when a transfer characteristic of said simulated model becomes other than appropriately 1, said adaptive controller model operates such that a transfer characteristic of said engine model and adaptive controller model becomes appropriately 1; and at least one injector for injecting fuel into individual cylinders according to said transfer characteristic of said engine model output by said microcomputer.

26. A system according to claim 25, wherein said plurality of engine operation detecting sensors includes an air/fuel ratio sensor and wherein said air/fuel ratio is determined through an output of said air/fuel ratio sensor installed at a location installed at a confluence point of an exhaust section of said multi-cylinder internal combustion engine, by:

deriving means for deriving a behavior of said exhaust system in which X(k) is observed from a state equation and an output equation in which an input U(k) indicates an air/fuel ratio of an air and fuel mixture supplied to each cylinder of said plurality of cylinders and an output Y(k) indicates an air-fuel ratio value by said air/fuel ratio sensor at said confluence point of said exhaust system as $$X(K+1)=AX(k)+BU(k)$$

$$Y(k)=CX(k)+DU(k)$$

where A, B, C and D are coefficients from matrices dependent on the number of said plurality of cylinders, assuming means for assuming said input U(k) as a predetermined value to establish an observer expressed by an equation using said output Y(k) as an input in which a state variable X indicates said air/fuel ratio at each cylinder as $$\hat{X}(k+1)=(A-KC)\hat{X}(k)+Y(k)$$

where K is a gain matrix; and determining means for determining said estimated air-fuel ratio of said air and fuel mixture being supplied to each cylinder of said plurality of cylinders from said state variable X.

27. A system according to claim 25, wherein said actual cylinder air flow is determined by:

air flow determining means for assuming a throttle provided at an air intake passage of said engine as an orifice to establish a fluid dynamic model and based on said model, determining air flow passing therethrough at least using detected pressures upstream and downstream of said throttle;

air amount determining means for determining air filling a chamber in said passage extending from said throttle to an intake port of said cylinder using ideal-gas law;

difference determining means for determining change of said air in said chamber from pressure change in said chamber; and cylinder air flow estimating means for estimating a cylinder air flow by subtracting said change of said air in said chamber from said throttle passing air flow.

28. A system according to claim 25, wherein said characteristics predetermined in response to said operating states of said engine includes at least one defined with respect to manifold pressure or engine speed.

29. A system according to claim 28, wherein said characteristics predetermined in response to said operating states of said engine are determined in advance and stored as mapped data in a memory of said microprocessor means.

30. A system according to claim 25, further including a dead time parameter provided to at least one of an input and an output of said engine model in response to said engine model output.

31. A system according to claim 25, a dead time factor is additionally provided.

32. A system according to claim 31, wherein an order of said dead time factor is varied in response to at least one of said operating states of said engine and said fuel metering control system itself.

33. A system according to claim 25, wherein said cylinder air flow is determined by:

air flow determining means for determining air flow Gth passing through a throttle valve in response to throttle opening using an equation based on a fluid dynamic model and defined as;

$$Gth = C \cdot S \cdot \rho \cdot \sqrt{\frac{2g \cdot (P1 - P2)}{\gamma}}$$

where C: a coefficient, S: throttle projection area, $\rho$: air density at throttle's upstream side, g: gravitational acceleration, $\gamma$: air specific weight on throttle's upstream side, P1: pressure on throttle's upstream side, P2: pressure on throttle's downstream side;

chamber filling air determining means for determining air Gb filling a chamber in said passage extending from said throttle valve to an intake port of said cylinder using ideal-gas law;

air change determining means for determining change delta Gb of said air Gb in said chamber from change in pressure in said chamber; and cylinder air flow estimating means for estimating a cylinder air flow Gair by subtracting said change delta Gb of said air Gb in said chamber from said throttle passing air flow Gth.

34. A system according to claim 33, wherein said pressure P1 upstream of said throttle valve is measured at a position away from said throttle valve at least by 1D when a diameter of said air intake passage is defined as D.

35. A system according to claim 33, wherein said pressure P2 downstream of said throttle valve is measured at a position away from said throttle valve at least by 3D when a diameter of said air intake passage is defined as D.

36. A system according to claim 33, wherein said pressure P2 downstream of said throttle valve is determined from said pressure at said chamber.

37. A system according to claim 33, wherein one of said plurality of engine operation sensors is a sensor for measuring throttle opening and wherein resolving power of said sensor for measuring throttle opening is set to be increased with decreasing throttle opening.

38. A system according to claim 33, wherein one of said plurality of engine operating sensors is a sensor for measuring throttle opening and wherein resolving power of said sensor for measuring said pressure P2 downstream of said throttle valve is increased with increasing pressure.

39. A system according to claim 33, wherein said coefficient is determined from throttle opening and a value indicative of engine load at least one among manifold pressure, a deviation between manifold pressure and atmospheric pressure and a ratio of manifold pressure to atmospheric pressure.

40. A system according to claim 39, wherein said coefficient is determined from throttle opening and engine load in advance and is stored as mapped data in a computer memory.

41. A system according to claim 40, wherein an interval between adjacent lattice points in said mapped data is set to be smaller with decreasing throttle opening.

42. A system according to claim 39, wherein a critical throttle opening at which engine load becomes maximum is determined with respect to engine speed and when a detected throttle opening exceeds said critical throttle opening, said detected value is replaced with said critical value.

43. A system according to claim 39, wherein said coefficient C includes at least flow rate coefficient.

44. A system according to claim 33, wherein said pressures upstream and downstream of said throttle valve P1 and P2 are respectively represented by atmospheric pressure and manifold pressure and said determined air flow passing through said throttle valve is calculated in advance to be stored as mapped data in a computer memory.

45. A system according to claim 12, wherein an order of said dead time parameter is varied in response to at least one of operating states of said engine and said fuel metering control system itself.

* * * * *

UNITED STATES PATENT AND TRADEMARK OFFICE

CERTIFICATE OF CORRECTION

PATENT NO. : 5,448,978

DATED : September 12, 1995

INVENTOR(S) : HASEGAWA et al.

It is certified that error appears in the above-indentified patent and that said Letters Patent is hereby corrected as shown below:

In Column 21, line 27, delete "X." and insert therefor --X.--.

In Column 23, lines 21-22, delete "cylinder internal combustion engine comprising: a plurality of engine operating detecting sensors; and insert therefor --cylinder internal combustion engine comprising:

a plurality of engine operation detecting sensors;-- line 53, delete "appropriately" and insert therefore --approximately--.

line 56, delete "appropriately" and insert therefor --approximately--.

In Column 24, line 29, delete "X." and insert therefor --X.--.

UNITED STATES PATENT AND TRADEMARK OFFICE

CERTIFICATE OF CORRECTION

PATENT NO. : 5,448,978

DATED : September 12, 1995

INVENTOR(S) : HASEGAWA et al.

It is certified that error appears in the above-indentified patent and that said Letters Patent is hereby corrected as shown below:

In Column 26, line 5, delete "operating" and insert therefor --operation--.

Signed and Sealed this

Fourteenth Day of May, 1996

*Attest:*

Bruce Lehman

BRUCE LEHMAN

*Attesting Officer*

*Commissioner of Patents and Trademarks*